US008205787B2

(12) United States Patent
Panduro, Jr. et al.

(10) Patent No.: US 8,205,787 B2
(45) Date of Patent: Jun. 26, 2012

(54) STACKABLE PACKING TRAY WITH DIAGONAL CORNERS

(75) Inventors: Edmundo Panduro, Jr., El Paso, TX (US); Stanley L. Fry, West Covina, CA (US)

(73) Assignee: International Paper Company, Memphis, TN (US)

( * ) Notice: Subject to any disclaimer, the term of this patent is extended or adjusted under 35 U.S.C. 154(b) by 1228 days.

(21) Appl. No.: 11/495,147

(22) Filed: Jul. 27, 2006

(65) Prior Publication Data

US 2007/0051789 A1 Mar. 8, 2007

Related U.S. Application Data

(60) Provisional application No. 60/702,879, filed on Jul. 27, 2005.

(51) Int. Cl.
*B65D 5/00* (2006.01)

(52) U.S. Cl. ..... 229/143; 229/173; 229/178; 229/919

(58) Field of Classification Search ..... 229/143, 229/173, 178, 919
See application file for complete search history.

(56) References Cited

U.S. PATENT DOCUMENTS

| | | | | |
|---|---|---|---|---|
| 1,438,182 | A | 12/1922 | Kondolf | |
| 1,600,260 | A * | 9/1926 | Walter | 229/143 |
| 2,295,141 | A | 9/1942 | Van Wingen | |
| 2,350,932 | A | 6/1944 | Schaefer | |
| 2,934,250 | A | 4/1960 | Stotz | |
| 3,114,493 | A | 12/1963 | Dunkin | |
| 3,669,341 | A * | 6/1972 | Hughes | 229/125 |
| 3,899,121 | A | 8/1975 | Herbetko | |
| 3,924,801 | A * | 12/1975 | Partain | 229/168 |
| 3,940,053 | A | 2/1976 | Putman et al. | |
| 3,973,723 | A | 8/1976 | Owens | |
| 4,134,533 | A * | 1/1979 | Heavner | 206/509 |
| 4,151,948 | A | 5/1979 | de la Fuente, Jr. | |
| 4,245,773 | A | 1/1981 | Stollberg | |
| 4,291,830 | A * | 9/1981 | Sorensen | 229/143 |
| 4,347,968 | A | 9/1982 | Cornell et al. | |
| 4,356,952 | A | 11/1982 | Rekow | |
| 4,418,863 | A | 12/1983 | Kimbrell, Sr. | |
| 4,537,344 | A * | 8/1985 | Thomas | 229/169 |
| 4,546,913 | A | 10/1985 | Castillo | |
| 4,770,339 | A | 9/1988 | Weimer | |
| 4,883,221 | A | 11/1989 | Brundage | |
| 4,884,739 | A | 12/1989 | Nederveld | |
| 4,911,355 | A | 3/1990 | Bannister | |
| 4,923,113 | A | 5/1990 | Guijarro | |
| 5,002,224 | A | 3/1991 | Muise | |
| 5,028,000 | A * | 7/1991 | Chabot et al. | 229/143 |
| 5,163,609 | A * | 11/1992 | Muise, Jr. | 229/113 |
| 5,289,970 | A | 3/1994 | McClure | |

(Continued)

FOREIGN PATENT DOCUMENTS

AU 6136190 3/1991

(Continued)

*Primary Examiner* — Nathan J Newhouse
*Assistant Examiner* — Latrice Byrd
(74) *Attorney, Agent, or Firm* — Thomas W. Barnes, III; Thomas W. Ryan, III

(57) ABSTRACT

This invention relates to stackable, open-topped, partially-lidded, and/or fully-lidded shipping and/or display container, and more particularly to a corrugated paperboard stackable container for shipping and displaying products such as, for example, agricultural produce.

7 Claims, 14 Drawing Sheets

U.S. PATENT DOCUMENTS

| | | | | |
|---|---|---|---|---|
| 5,294,044 | A | 3/1994 | Clark | |
| 5,361,976 | A | 11/1994 | Blomfield | |
| 5,429,296 | A | 7/1995 | Southwell et al. | |
| 5,452,848 | A | 9/1995 | Mur Gimeno | |
| 5,458,283 | A | 10/1995 | Southwell et al. | |
| 5,487,505 | A | 1/1996 | Nilsson | |
| 5,535,941 | A | 7/1996 | Garza | |
| 5,649,663 | A | 7/1997 | Pestow, Jr. | |
| 5,673,848 | A | 10/1997 | Garza | |
| 5,860,590 | A | 1/1999 | Blomfield | |
| 6,116,498 | A | 9/2000 | Sheffer | |
| 6,158,652 | A | 12/2000 | Ruiz et al. | |
| 6,302,323 | B1 | 10/2001 | Southwell | |
| 6,402,020 | B1 | 6/2002 | McClure | |
| 6,502,698 | B1 | 1/2003 | McKenna | |
| 6,604,675 | B2 | 8/2003 | Southwell | |
| 6,899,266 | B2 | 5/2005 | Conway | |
| 7,467,743 | B1 * | 12/2008 | Philips | 229/169 |
| 7,635,080 | B2 | 12/2009 | Conway | |
| 2002/0125307 | A1 | 9/2002 | McClure | |
| 2004/0041015 | A1 | 3/2004 | Fry | |
| 2004/0256448 | A1 | 12/2004 | Blomfield et al. | |
| 2005/0017061 | A1 * | 1/2005 | Quaintance | 229/125.28 |
| 2005/0040217 | A1 | 2/2005 | Fry | |
| 2005/0145687 | A1 * | 7/2005 | Conway | 229/174 |
| 2005/0236466 | A1 * | 10/2005 | McLeod | 229/143 |
| 2006/0091194 | A1 | 5/2006 | Fry | |
| 2007/0051789 | A1 | 3/2007 | Panduro et al. | |
| 2009/0272789 | A1 | 11/2009 | Fry | |

FOREIGN PATENT DOCUMENTS

| | | |
|---|---|---|
| AU | 643884 | 11/1993 |
| DE | 4017416 | 12/1990 |
| DE | 4102166 | 7/1992 |
| EP | 0326451 | 8/1989 |
| EP | 444004 | 8/1991 |
| FR | 1383824 | 9/1963 |
| FR | 2306888 | 11/1976 |
| FR | 2615822 | 12/1988 |
| FR | 2651482 | 3/1991 |
| FR | 2682936 | 4/1993 |
| GB | 2086352 | 5/1982 |
| GB | 2173480 | 10/1986 |
| GB | 2188036 | 9/1987 |
| GB | 2232403 | 12/1990 |
| GB | 2264484 | 9/1993 |
| GB | 2266705 | 11/1993 |
| GB | 2267697 | 12/1993 |

* cited by examiner

STACKABLE PACKING TRAY WITH DIAGONAL CORNERS

BACKGROUND OF THE INVENTION

The present application claims the benefit of priority under 35 USC §119(e) to U.S. Provisional Patent Application 60/702,879, filed Jul. 27, 2005, which is hereby incorporated, in its entirety, herein by reference.

1. Field of the Invention

This invention relates to stackable, open-topped, partially-lidded, and/or fully-lidded shipping and/or display container, and more particularly to a corrugated paperboard stackable container for shipping and displaying products such as, for example, agricultural produce.

2. Prior Art

Containers made from corrugated paperboard are commonly used for shipping and storing various products, including agricultural produce. One preferred container includes a bottom wall, opposite side walls, opposite end walls, and an open top. Stacking tabs on the upper edges of the side and/or end walls engage in slots or openings in the bottom of another tray when the trays are stacked on top of one another to achieve stacking stability. These trays offer good stacking strength and stability, and also provide excellent product presentation due to the open top, and the side panel surfaces that permit display of graphics and the like. Further, recent improvements to these trays have included inwardly inclined side or end panels with correspondingly inclined stacking tabs to provide greater resistance to nesting or telescoping of stacked trays, and to allow units to be easily palletized.

Typically, these trays are formed from a single blank of corrugated paperboard scored with score lines or cut lines, and folded into a finished tray by automated machines or by hand. Machine forming can be accomplished in a continuous in-line process involving cutting, scoring and folding the trays from continuous sheets of paperboard. In order to achieve a desired stacking strength in conventional produce trays, different weights (thicknesses) of material are used in the construction of the tray.

Conventional produce trays have inner and outer side wall panels that form square outer corners and angled or diagonal inner corners. The diagonal inner corners extend into the tray interior space and limit to a certain extent the type, style or number of clamshell grape lugs, for example, that can be placed in the tray.

It would be desirable to have a tray with the advantages of the conventional produce tray, but that uses less material in its construction and has interior space to accommodate commonly used clamshell grape lugs, for example. Further, it would be desirable to have a tray or shipping and/or display container that is capable of having either a partially-lidded or fully-lidded feature that allows ventilation and/or access of goods contained therein to the consumer and protects the goods at the same time while in transport and/or during stacking.

SUMMARY OF THE INVENTION

The present invention is a produce style tray with improved stacking strength and increased interior space, while requiring less material to make than prior art trays. The tray of the invention has inner and outer wall panels that form diagonal corners both inside and outside the tray. In one embodiment, the diagonal corner is single ply and is formed on an outer side wall panel, thus increasing the interior space of the tray while maintaining the diagonal corner configuration, and in another embodiment the inner and outer wall panels each has diagonal corner panel, thus forming double ply diagonal corners.

The trays according to preferred embodiments of the invention are formed from blanks of corrugated paperboard cut and scored to form a bottom panel with an end wall panel foldably joined to opposite end edges thereof. Opposite outer side wall panels are foldably joined to the opposite side edges of the bottom panel, and an inner side wall panel is foldably joined to the outer or upper edge of each outer side wall panel. A minor flap is foldably joined along a pair of spaced apart fold lines to each of the opposite ends of at least the outer side wall panels. These minor flaps comprise sealing flaps that are secured relative to respective end wall panels, and the spaced apart fold lines of each pair define between them diagonal corner panels in the erected tray.

In one embodiment, diagonal corner panels are formed only in the outer side wall panels. Provision of the diagonal corner panels in the outer side wall panels moves the diagonal corner panels farther out relative to the interior of the tray, thus increasing the interior space over that available in conventional produce trays, wherein the diagonal corner panels are formed on the inner wall panels. Additionally, the inner side wall panels may be devoid of minor flaps extending from their ends, reducing the amount of material required to produce the tray.

In another embodiment, minor flaps are foldably joined along pairs of spaced apart fold lines to opposite ends of both the inner and outer side wall panels, forming diagonal corner panels on both the inner and outer side wall panels, resulting in double ply diagonal corners. This construction permits a lighter weight material to be used in forming the tray, while achieving the same strength as obtained in conventional trays that require a heavier weight material.

In both embodiments, at least the bottom edges of the minor flaps can extend at an acute angle relative to the bottom edges of the respective side wall panels, whereby when the panels are folded to form an erected tray, the side walls are inwardly inclined, or lean in at their top edge, thus defining a smaller footprint at the top of the tray than at the bottom and helping to prevent an upper tray from telescoping or nesting into a lower tray when the trays are stacked on top of one another.

Additionally, the stacking tabs formed on the upper edges of the side and/or end walls extend coplanar with the respective side and/or end wall, i.e., the stacking tabs are inwardly inclined or lean in at the same angle as the respective side and/or end wall, and are adapted to be received in and captured by slots or openings in the bottom of another tray.

In a preferred construction, bendable tongues project into the tab-receiving slots from one side thereof and help define a friction lock mechanism to hold the stacking tabs in the slots.

In another embodiment the container of the invention has opposed side walls, opposed end walls, a bottom wall, and a lid, said bottom wall cooperating with the side walls and end walls to define an interior space. The lid is foldably connected along a fold line to an upper edge of at least one of the end walls, and is foldable relative to the end wall so as to be moveable between an open position and a closed position. The lid may completely cover the interior space, or only partially cover it when in its closed position. A minor flap is on each of the opposite ends of each side wall, and these minor flaps are folded inwardly from the side walls and lie against a respective adjacent end wall. A shaped notch is formed in an upper edge of the minor flap, and a self-locking feature is formed in the lid adjacent each minor flap. Each self-locking feature is defined by spaced cuts extending into the lid from the fold line to form a roll-over flap cut from the lid. The roll-over flap is connected at one end thereof with an associated end wall by a web, and the cuts extend across the fold line at opposite ends of the web and into the end wall to define a heel on said one end of the roll-over flap, said heel being cut from an upper edge of the end wall. Each roll-over flap is folded from the plane of the lid and inwardly and downwardly over an adjacent minor flap to lie against an inner surface of a respective adjacent minor flap, with the web received in the shaped notch and the heel extending upwardly from the roll-over flap and lying against an inner surface of a respective adjacent minor flap. The roll-over flaps hold the minor flaps in position against a respective end wall. Openings are formed in the lid where material has been removed between said cuts to form said roll-over flaps.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAILED DESCRIPTION OF PREFERRED EMBODIMENTS

Figure 1:
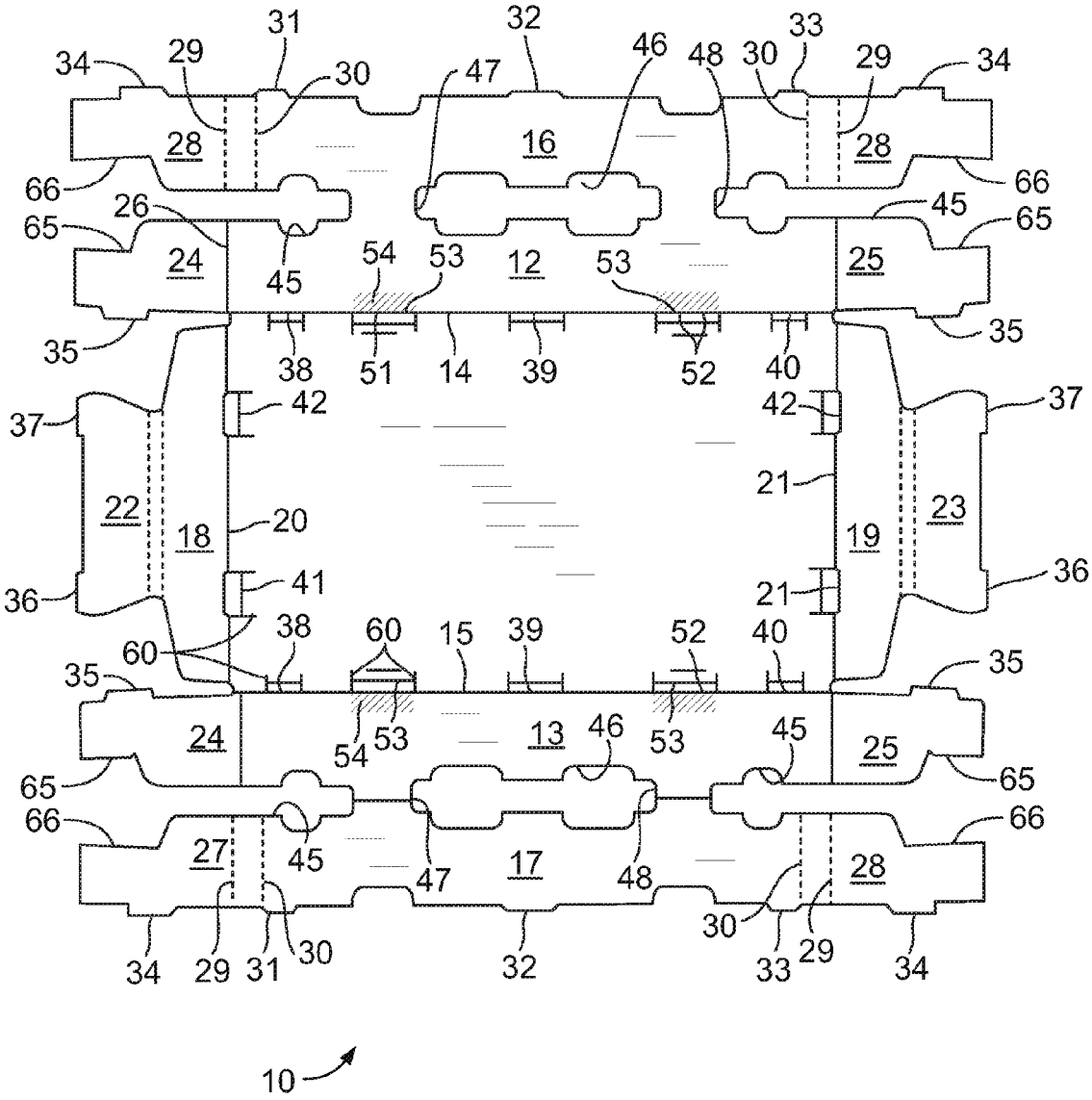
FIG. 1 is a plan view of a blank for making a conventional produce tray.

Referring to FIG. 1, a blank 10 for producing a conventional produce tray has a bottom panel 11, outer side wall panels 12 and 13 foldably joined along fold lines 14 and 15 to opposite side edges of the bottom panel, inner side wall panels 16 and 17 foldably joined to the outer or upper edge of the outer side wall panels, end wall panels 18 and 19 foldably joined along fold lines 20 and 21 to opposite ends of the bottom panel, and locking roll-over panels 22 and 23 foldably joined to the outer or upper edges of the end wall panels. Minor flaps 24 and 25 are foldably joined to opposite ends of each of the outer side wall panels along single fold lines 26, and minor flaps 27 and 28 are foldably joined to opposite ends of each of the inner side wall panels along pairs of spaced apart fold lines 29 and 30.

Locking tabs 31, 32 and 33 project from the free edge of panels 16 and 17, this free edge being the bottom edge in an erected tray. Locking tabs 34 also project from one side edge of the minor flaps 27 and 28, and corresponding locking tabs 35 project from one side edge of minor flaps 24 and 25. These side edges correspond to the bottom sides of the minor flaps in an erected tray. In addition, locking tabs 36 and 37 project from opposite ends of the free edge of each of roll-over panels 22 and 23.

Slots or openings 38, 39 and 40 are provided in the bottom panel closely adjacent to or contiguous with the respective fold lines 14 and 15, in positions to receive the locking tabs 31, 32 and 33 when the panels are folded into operative erected position, and similar but larger openings 41 and 42 are formed in opposite ends of the bottom panel closely adjacent to or contiguous with the fold lines 20 and 21, in positions to receive the locking tabs 34, 35, 36 and 37 on the minor flaps and on the roll-over panels, respectively, when the tray is erected. These locking tabs and slots function to hold the tray in its erected position.

Cut-outs 45 and 46 are made in the material of the inner and outer side wall panels, spanning the fold line between them, leaving connecting webs 47 and 48 that form stacking tabs 49 and 50 (see, e.g., FIG. 5) in a tray erected from the blank.

Stacking tab-receiving openings 51 and 52 are formed in the bottom panel at opposite ends thereof adjacent to or contiguous with the fold lines 20 and 21 for receiving the stacking tabs 49, 50 on a subjacent tray when the trays are stacked on top of one another.

Bendable tongues 53 project into the openings 51 and 52 from the side thereof opposite the respective fold lines 14 and 15 and with the openings and stacking tabs form a friction locking mechanism that securely but releasably holds the stacking tabs in the openings. Crushed areas 54 may be formed in the material of the blank along the side of the openings 51 and 52 opposite the side from which the tongues project, to provide additional clearance for stacking tabs extended into the openings.

Short relief cuts 60 preferably are made in the material of the blank along opposite sides of all the other openings formed in the bottom panel, defining somewhat flexible or bendable tabs or tongues in each of these openings to facilitate insertion of the locking tabs into the openings.

To erect a tray from the blank of FIG. 1, the panels 16 and 17 are folded upwardly and inwardly to lie against the respective panels 12 and 13, and these combined panels are folded upwardly about respective fold lines 14 and 15 into an upright position, with the locking tabs 31, 32 and 33 engaged in the slots 38, 39 and 40. The minor flaps 24, 25 and 27, 28 are then folded inwardly about their respective fold lines 26 and 29, 30, and the end wall panels 18 and 19 are then folded upwardly against the minor flaps, followed by folding the locking roll-over panels 22 and 23 inwardly and downwardly over the minor flaps, with the locking tabs 34, 35, 36 and 37 engaged in the openings 41 and 42 and the minor flaps sandwiched between the end wall panels and the roll-over panels.

It will be noted that each of the minor flaps 24, 25, and 27, 28 extend at a slight acute angle relative to the length axis of the respective side wall panels, and the outermost fold line 29 of the pair of fold lines joining minor flaps 27 and 28 to their respective inner side wall panels also is disposed at a corresponding angle. Accordingly, when the panels are all folded into their operative erected positions, the side wall panels are slightly inwardly inclined toward their upper edge.

The resulting conventional tray (not shown) has square outer corners defined by the single fold lines 26, and diagonal inner corners defined by the pairs of fold lines 29 and 30.

It will also be noted that in the particular example shown, the end wall panels 18 and 19 and the associated roll-over panels 22 and 23 have less height than the side wall panels 12, 13 and 16, 17, and the minor flaps 24, 25, 27 and 28 have recessed areas or cut-outs 65, 66 in their upper edges where the roll-over panel engages them. This construction provides a ventilation opening 70 (see, e.g., FIG. 5) in the upper edge of the end walls. The cut-outs 45 and 46, in addition to defining the stacking tabs, also provide ventilation openings 71 in the top edges of the side walls (see, e.g., FIG. 5).

Figure 2:
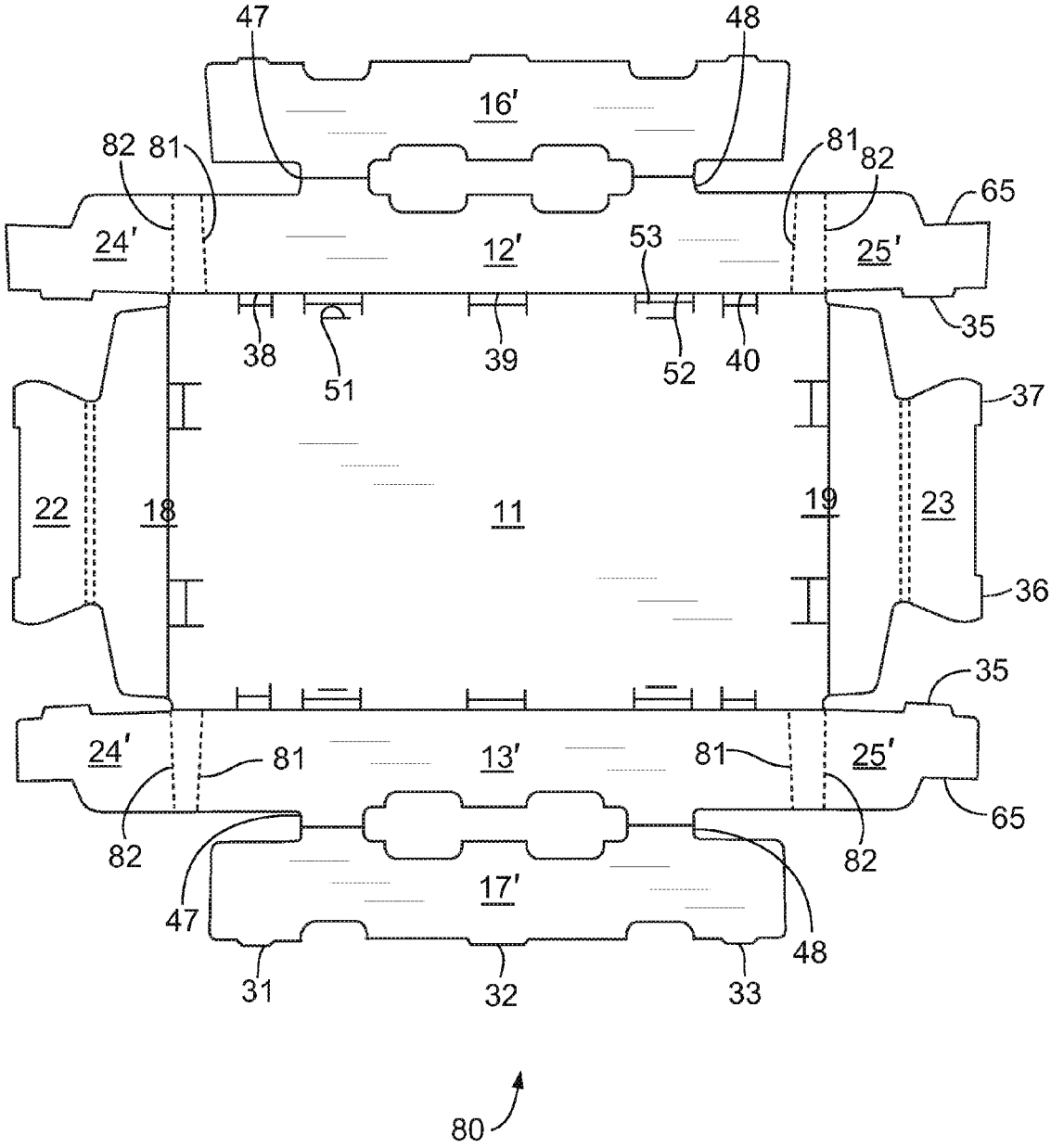
FIG. 2 is a plan view of a blank for making a first embodiment of a tray in accordance with the invention, wherein the tray has single ply diagonal corners.

A first embodiment of a blank for making a tray according to the invention is indicated generally at 80 in FIG. 2. This blank differs from that shown in FIG. 1 in that the minor flaps are omitted from the inner side wall panels 16' and 17', and the minor flaps 24', 25' are joined to their respective outer side wall panels 12', 13' by pairs of spaced fold lines 81, 82, rather than the single fold lines in the prior art. Other components corresponding to those shown in FIG. 1 are indicated by like reference characters. When the tray is erected by folding the panels of the blank into their operative positions, generally as discussed above, the square corners are eliminated and the diagonal corners are moved outwardly relative to the interior of the tray, affording more space and permitting the tray to accommodate more of the commonly used clamshell lugs used in the grape industry, for example. This embodiment also requires slightly less material than the prior art tray, yet retains the compressive or stacking strength of the former tray.

Figure 5:
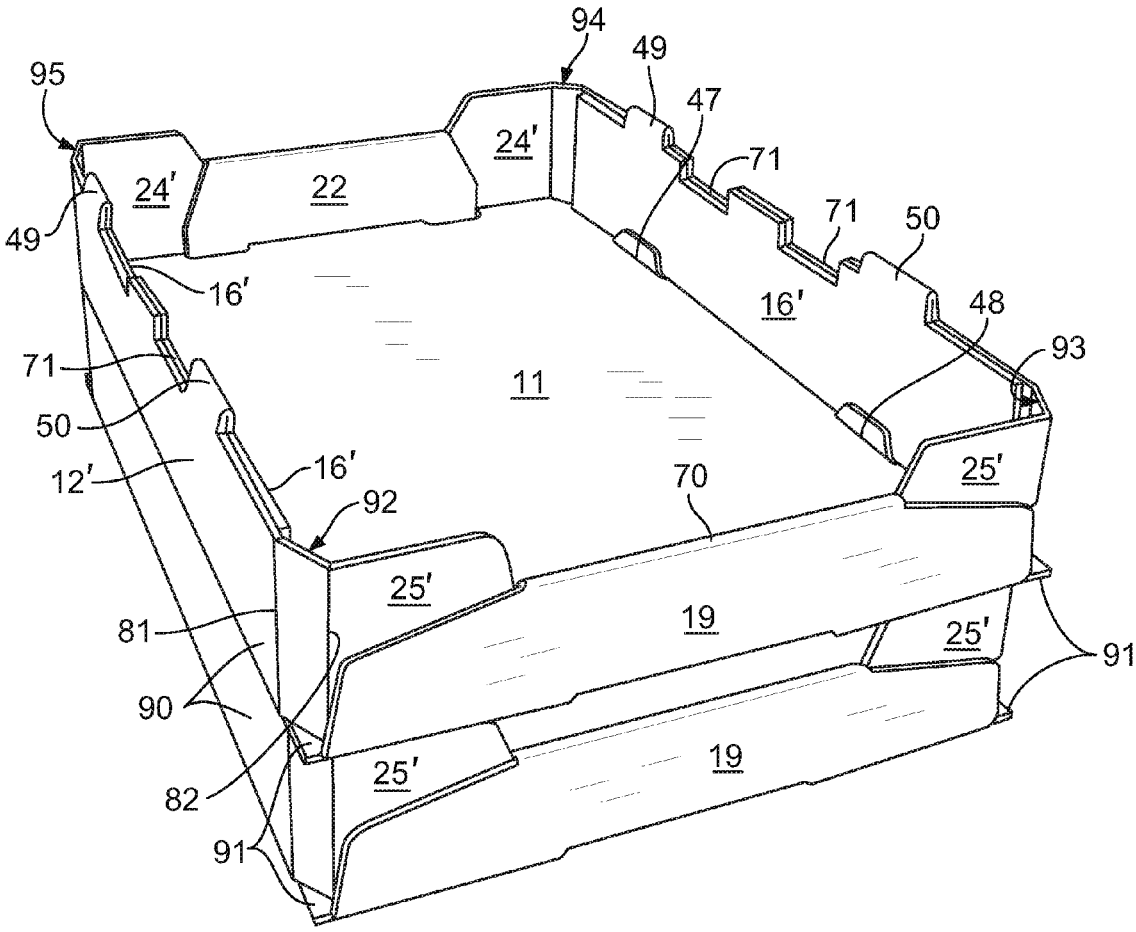
FIG. 5 is a top perspective view of a pair of stacked together trays having single ply diagonal corners, produced by using the blank of FIG. 2.
Figure 6:
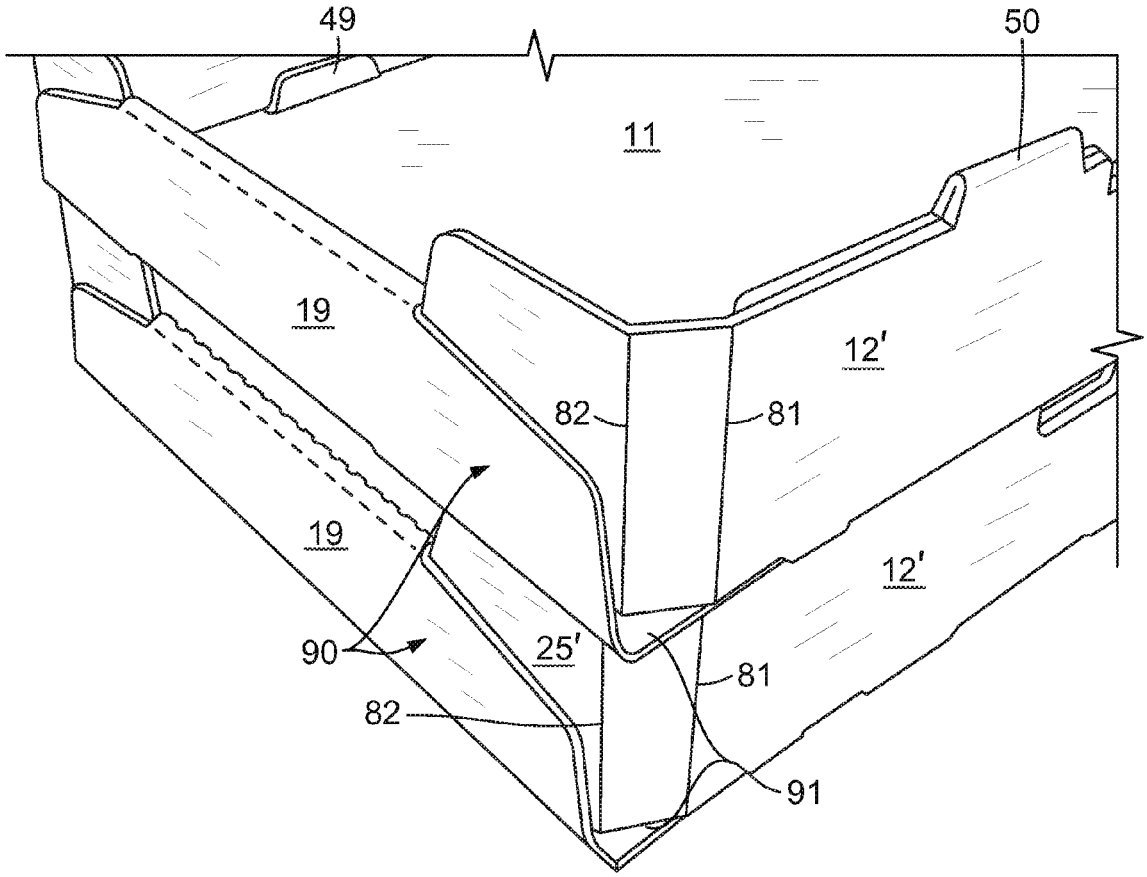
FIG. 6 is an enlarged fragmentary top perspective view of one corner of the stacked together trays of FIG. 5, viewed from outside the corner.
Figure 7:
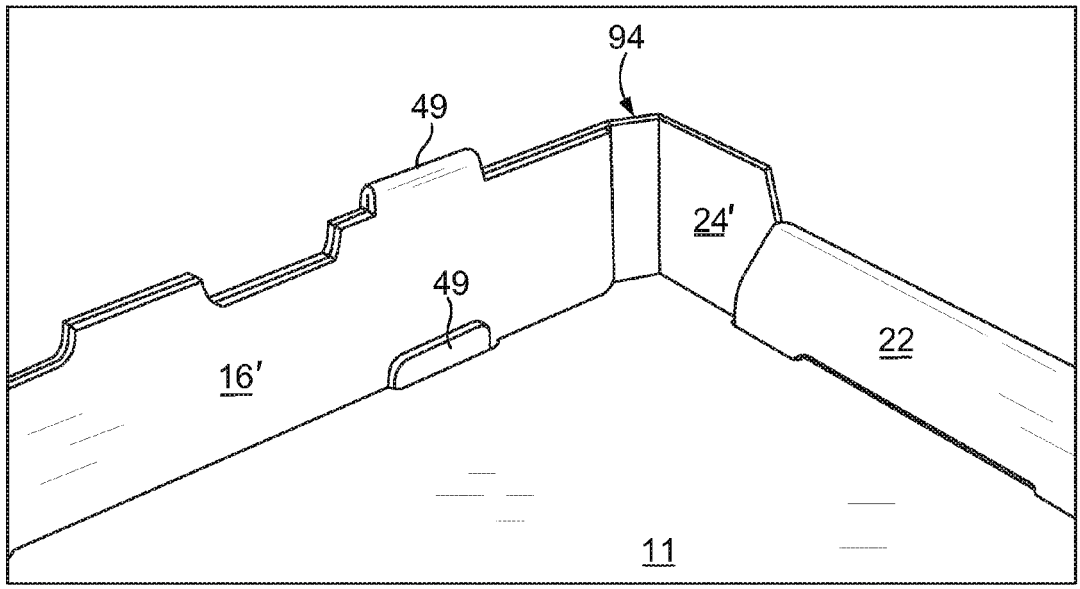
FIG. 7 is an enlarged fragmentary top perspective view of one of the trays of FIG. 5, viewed from inside the corner.

A tray 90 made from the blank of FIG. 2 is shown in FIGS. 5, 6 and 7. Note the stacking tabs 49 and 50, and ventilation openings 70 and 71. Further, it will be noted that the corners 91 of the bottom panel project beyond the diagonal corners 92, 93, 94 and 95, defining a square footprint that rests securely on top of a subjacent tray when the trays are stacked on top of one another, as shown in FIGS. 5 and 6.

Figure 3:
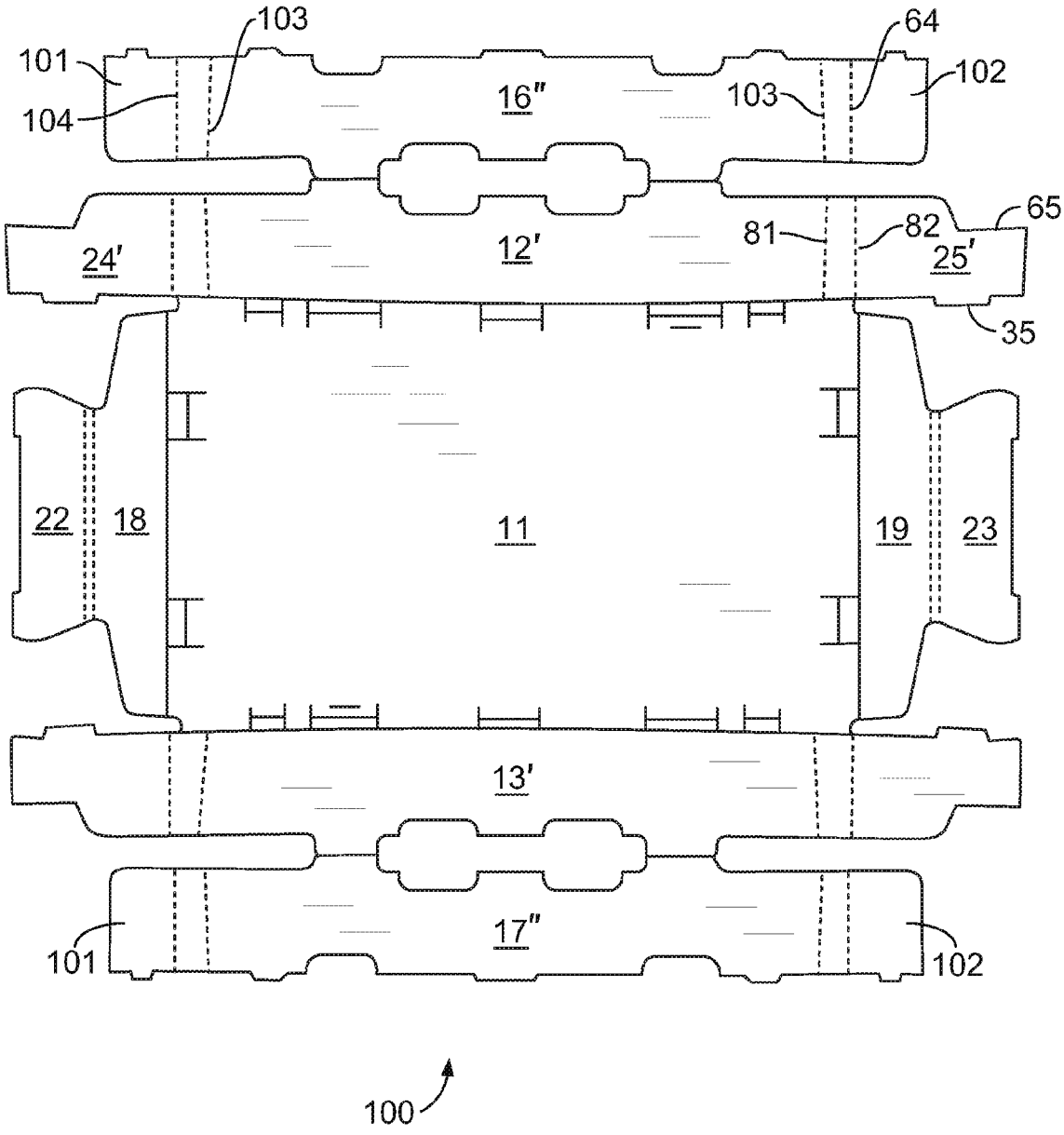
FIG. 3 is a plan view of a blank for making a second embodiment of a tray in accordance with the invention, wherein the tray has double ply diagonal corners and is adapted for manual or hand set-up.
Figure 8:
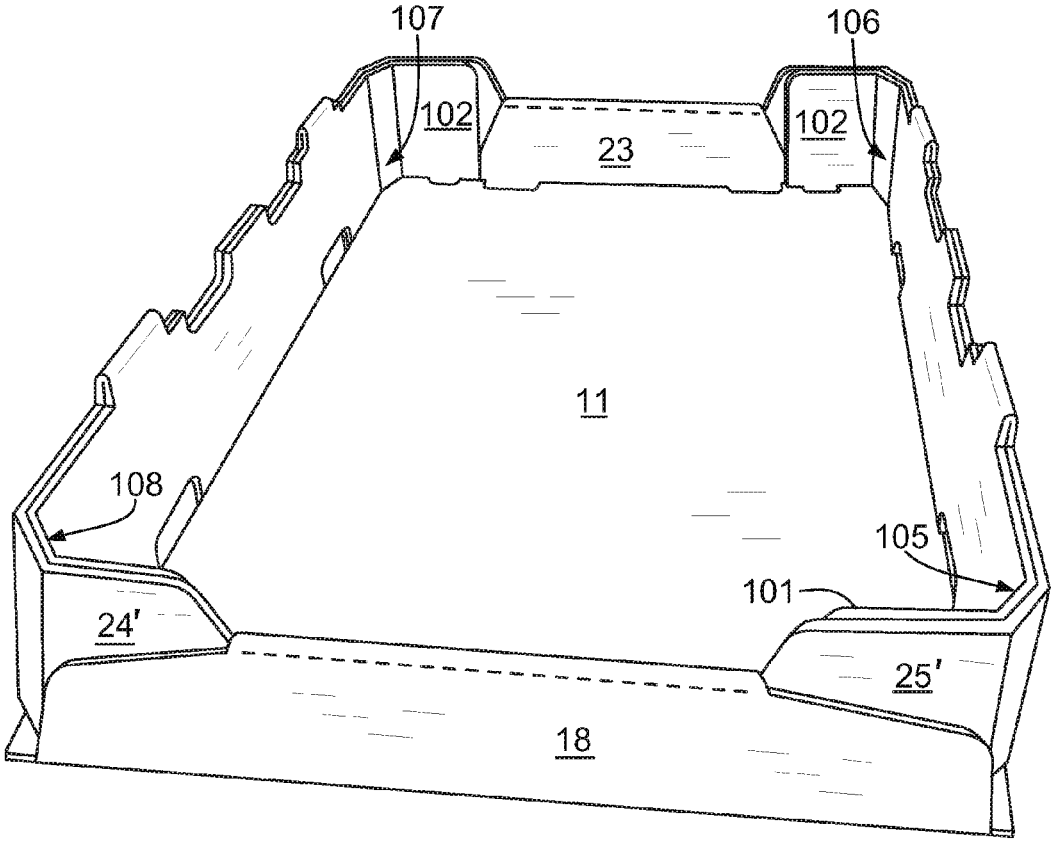
FIG. 8 is a top perspective view of a tray made using the blank of FIG. 3, wherein the diagonal corners are double ply.
Figure 9:
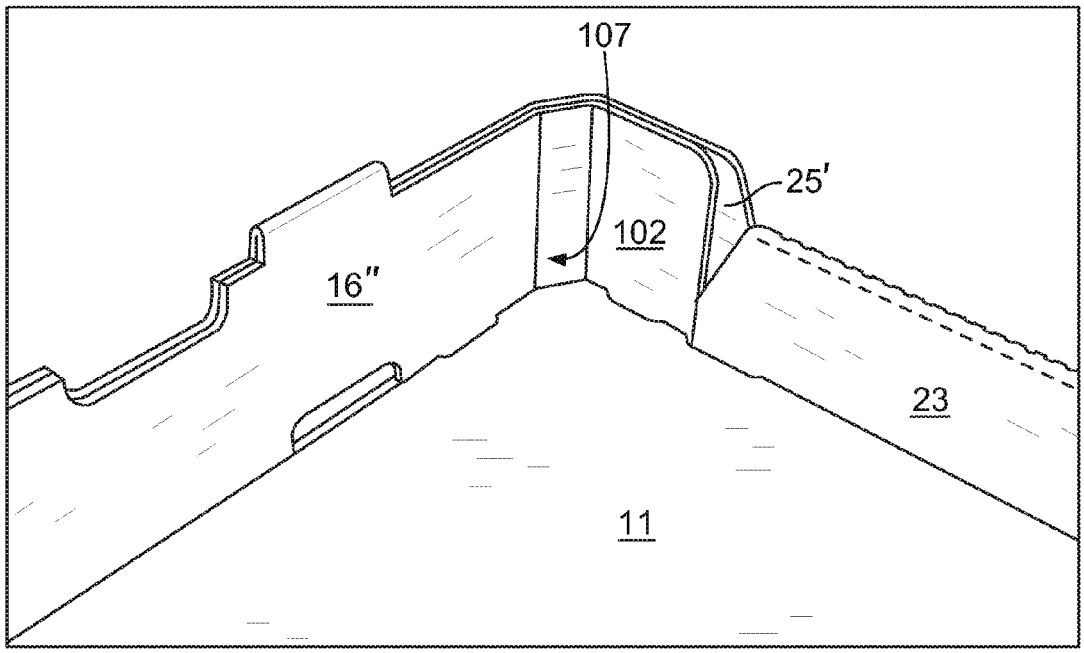
FIG. 9 is an enlarged fragmentary top perspective view of one corner of the tray of FIG. 8, viewed from inside the corner.

A second embodiment of a blank for making a tray according to the invention is indicated generally at 100 in FIG. 3, and like parts are indicated by like reference characters. This form of the invention is generally similar to that shown in FIG. 2, except that minor flaps 101 and 102 are foldably joined to the ends of the respective inner side wall panels 16" and 17" along spaced double fold lines 103 and 104. Accordingly, when the tray is erected, as shown in FIGS. 8 and 9, double ply diagonal corners 105, 106, 107 and 108 are produced. This version of the tray has approximately 24% greater stacking strength than conventional trays of this type.

Figure 4:
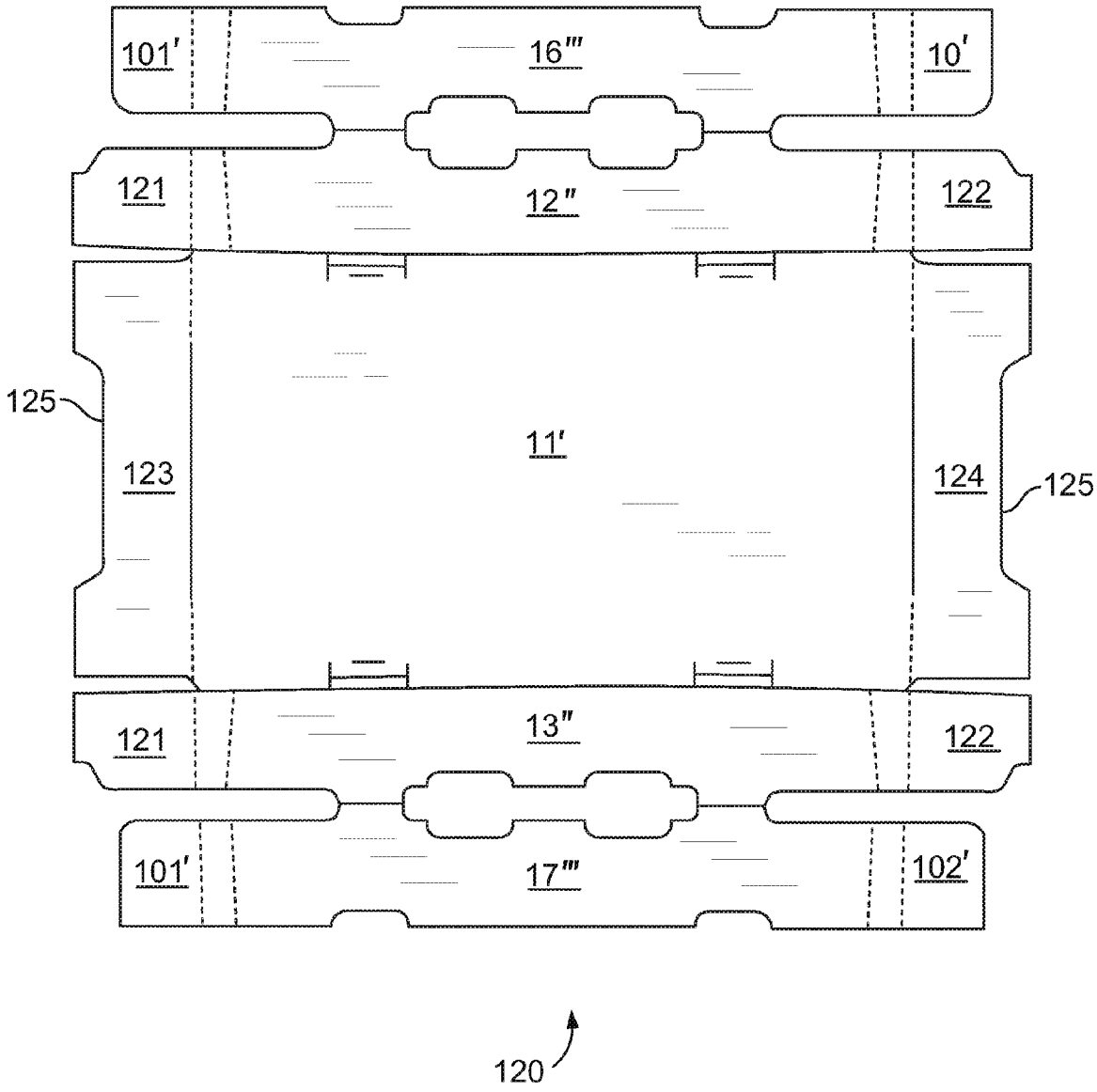
FIG. 4 is a plan view of a blank similar to that shown in FIG. 3, except the blank is adapted for machine set-up.

A third embodiment of a blank for making a tray according to the invention is shown at 120 in FIG. 4. This form of the invention is essentially the same as that form shown in FIG. 3, except that the FIG. 4 embodiments is designed for machine set-up. Thus, the locking tabs on the inner side wall panels 16''', 17''' and corresponding openings, and the locking roll-over panels are omitted. Further, the minor flaps 121 and 122 on the outer side wall panels 12", 13" are shorter in length than the minor panels 24', 25' on the FIG. 3 embodiment, since these flaps are not captured between the end panel and a roll-over panel, but are adhesively secured to the end panels 123 and 124, respectively. It will be noted that the end panels 123 and 124 are configured differently on their upper edges, having recessed areas 125 to form ventilation openings The stacking tabs can be positioned on either the end panels or the side panels and either the side walls or the end walls can be inwardly inclined. Further, the tray can be sized to be modular (half-sized or full sized) to allow interlocking with other trays that have stacking tabs properly positioned. The tray also can be made in various sizes (footprints) to accommodate two tabs per side or end or one tab per side or end.

Figure 10:
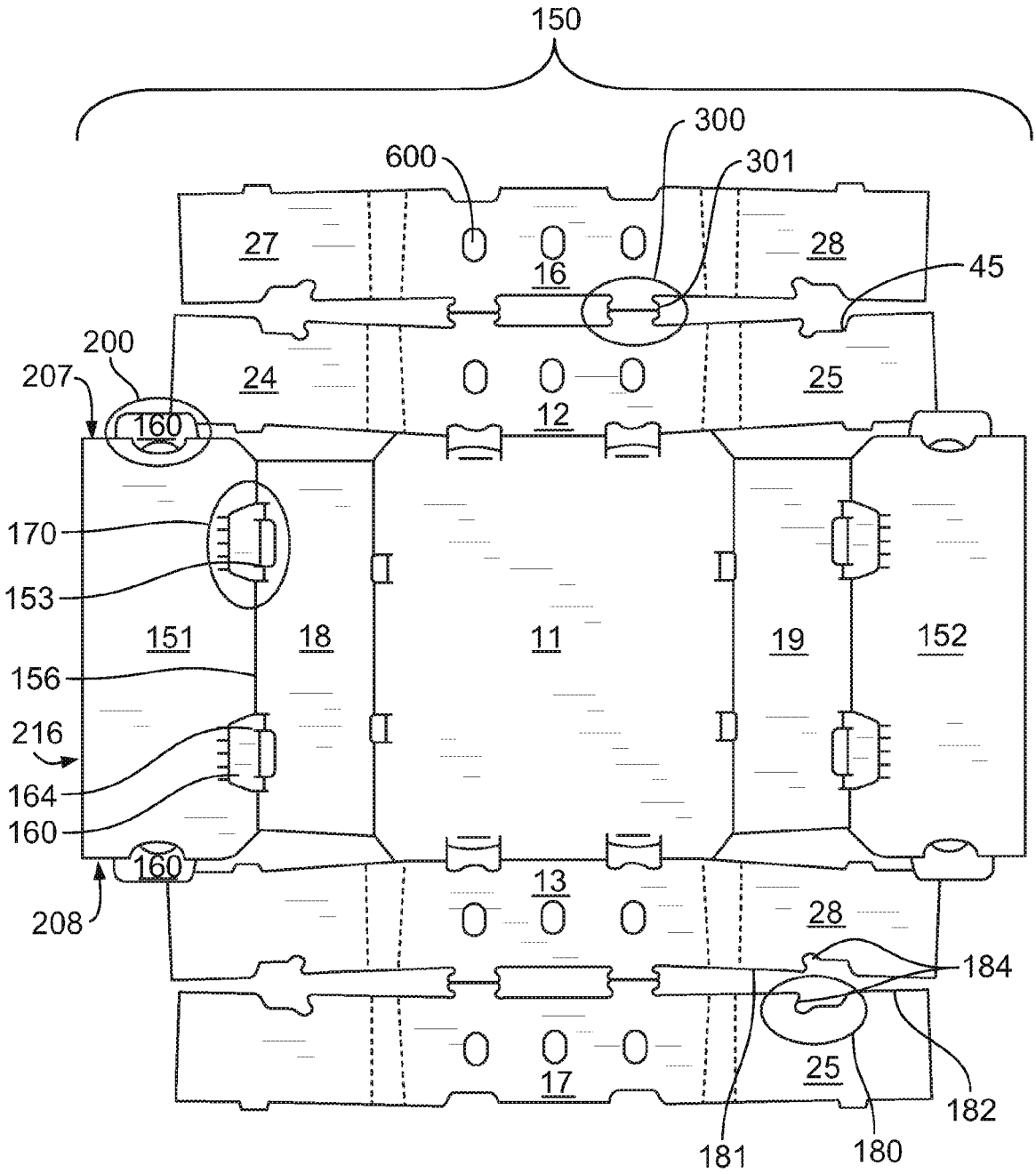
FIG. 10 is a plain view of a blank for making an embodiment of a tray in accordance with the invention, wherein the tray has a lid panel and, when constructed in the closed position, is fully lidded.
Figure 11:
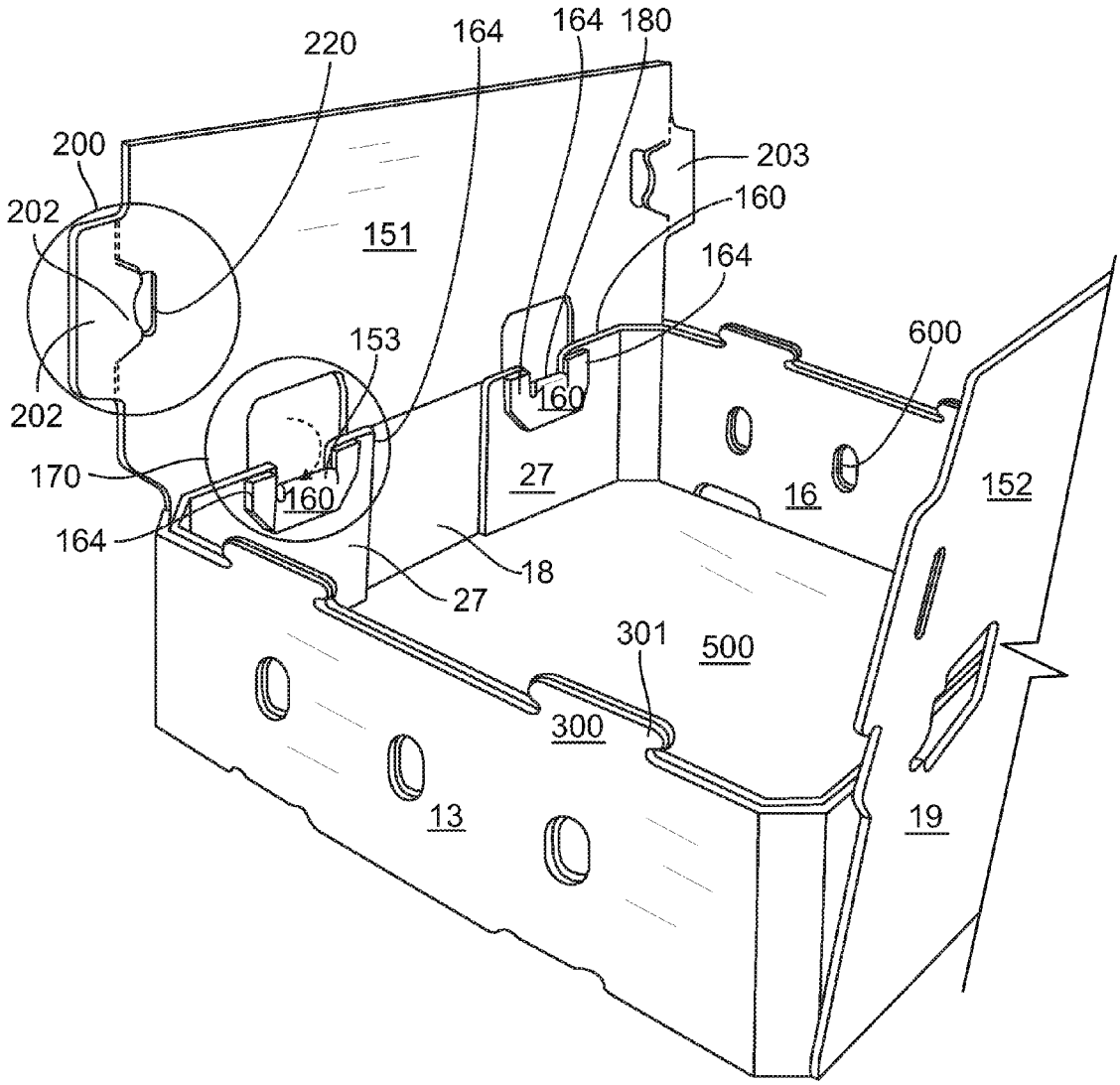
FIG. 11 is an enlarged fragmentary top perspective view of one embodiment of the present invention shown in FIG. 11, when the tray is constructed and the lid is in the open position and shows one embodiment of the self locking feature in the locked position.

The present invention also relates to a tray and/or container with the advantages of the conventional produce tray and/or the above-mentioned embodiments of the present invention and further has either a fully-lidded or partially-lidded feature that allows ventilation and/or access of goods contained therein to the consumer and protects the goods at the same time while in transport and/or during stacking. FIGS. 10 and 11 represent exemplified embodiments of blanks that, when constructed into their corresponding tray/container, have a fully-lidded feature and partially-lidded feature, respectively.

In an additional aspect of the invention, a blank generally referred to as 150 is shown in FIG. 10. A blank 150 differs from those conventional and inventive blanks described above (FIGS. 1-3 and 5-9) in that the roll over panels 22,23 are not provided and the blank 150 contains a lid panel 151,152. The lid panel 151,152 may be connected, preferably foldably connected via a fold line 156, to an end wall panel 18,19. In this embodiment, the end wall panel 18/19 may be longer, shorter, or equal to that of either of the inner side wall panel 16,17 and/or the outer side wall panel 12,13. As shown in FIG. 10, the end wall panels 18/19 are longer than that of either of the inner side wall panels 16,17 and/or the outer side wall panels 12,13.

Figure 12:
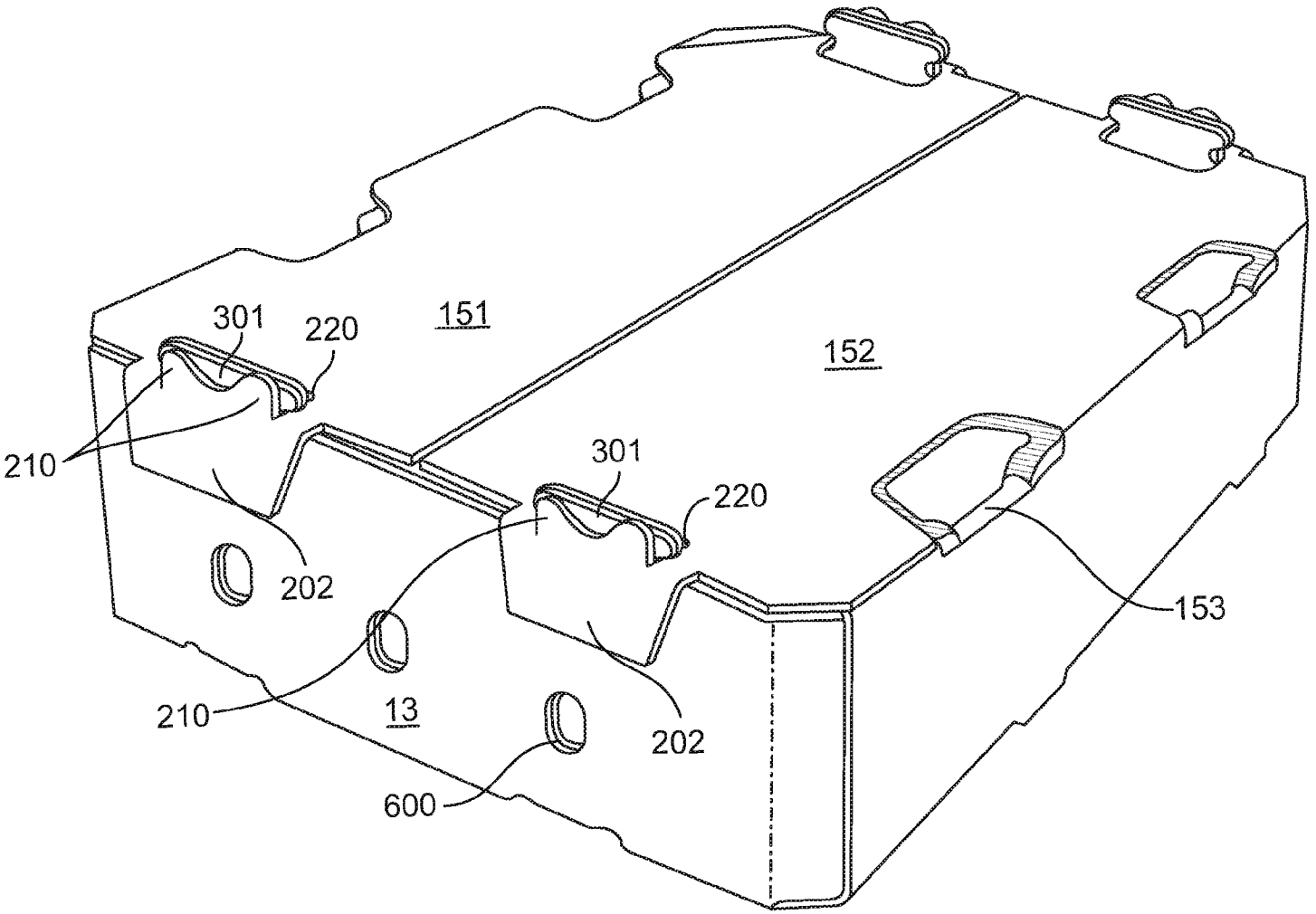
FIG. 12 is an enlarged fragmentary top perspective view of one embodiment of the present invention shown in FIG. 11, when the tray is constructed and the lid is in the closed position.

When the blank 150 is constructed, the lid panel 151,152 may be in an open or closed position. FIG. 11 shows one embodiment where the lid panel 151,152 is in the open position, while FIG. 12 shows one embodiment where the lid panel 151,152 is in the closed position. It can be appreciated that to place the lid panel 151,152 is in the open position, the lid panel 151,152 is folded upwardly to be approximately perpendicular to the bottom panel 11. When in the open position, the lid panel is spaced away from the interior space 500 of the tray/container, thereby allowing access to the interior space and any goods/products contained therein. The lid panel 151,152 may be folded inwardly as well so as to be placed is in the closed position, where the lid panel 151,152 is spaced above a portion of the interior space of the tray/ container, thereby reducing access to the interior space and any goods/products container therein. In the closed position, the lid panel 151,152 provides not only vertical stacking strength, but also protects the goods/products contained therein the interior space of the tray/container. Although the lid panel may be spaced in any orientation relative to the bottom, side and/or end wall panels, FIG. 12 provides a preferred embodiment that, when in the closed position, the lid panel 151,152 is approximately parallel to the plane of the bottom panel 11 and/or approximately perpendicular to the inner side wall panel 16,17 and/or the outer side wall panel 12,13. Further, in this preferred embodiment, the lid panel 151,152 is approximately parallel to the end wall panel 18, 19 . In addition, the lid panel 151,152 is spaced above a top edge of at least one inner side wall panel 16,17 and/or at least one outer side wall panel 12,13, when the lid panel 151,152 is in the closed position.

The size of each lid panel 151,152 may be of any size and shape, so long as when the lid panel 151,152 is in the closed position it is spaced above at least a portion of the interior space provided by the tray/container. In a preferred embodiment as shown in FIG. 12, each lid panel 151,152 has a width and/or length so each lid panel 151,152 is spaced above about half of the interior space of the tray/container when in the closed position, thereby resulting in approximately the entire interior space being covered by the lid panel 151,152. In alternative embodiments, it may be desirable to replace a plurality of lid panels 151,152 with a single lid panel 151,152 that achieves the above. In further alternatives, one or more lid panel 151,152 may be used and have a size and shape that, when in the closed position, does not cover the entire interior space of the tray/container. Further, one or more lid panel 151,152 may be used and have a size and shape that, when in the closed position, may or may not cover the entire interior space of the tray/container and may or may overlap one another.

Figure 13:
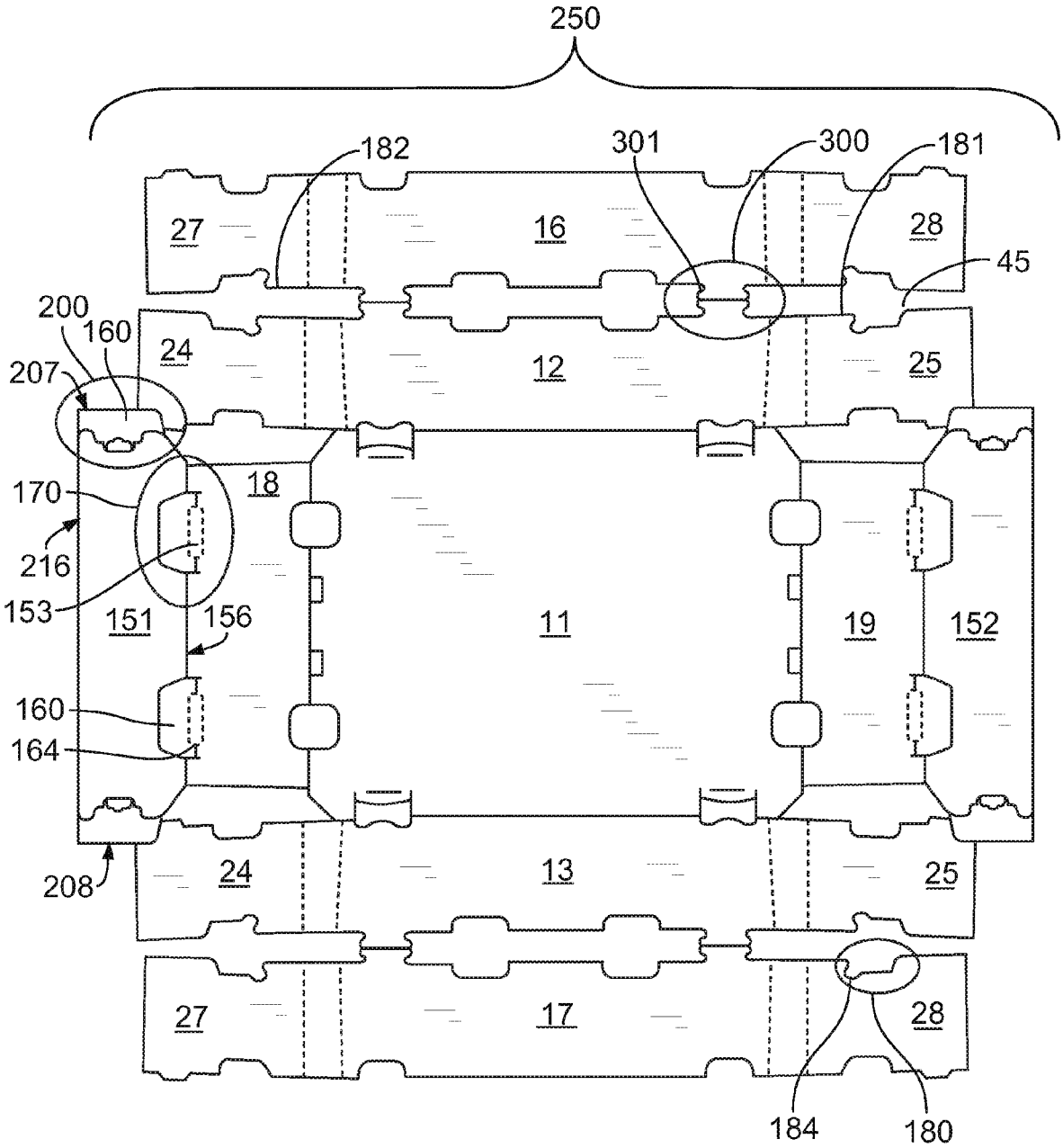
FIG. 13 is a plan view of a blank for making an embodiment of a tray in accordance with the invention, wherein the tray has a lid panel and, when constructed in the closed position, is partially lidded.

FIGS. 10 and 13 show exemplified embodiments of a first blank 150 and a second blank 250 containing the lid panel 151,152. The lid panel has outside edges 207,208,216. The lid panel 151,152 also contains at least one fastening feature 200 (discussed in detail below). When the lid panel 151,152 is in the closed position, the fastening feature 200 helps secure and fasten the lid panel 151,152 so as to immobilize the lid panel 151,152 when the lid panel 151,152 is spaced above a portion of the interior space of the tray/container, thereby locking the lid pane1 151,152 into the closed position and securing it so as to protect goods/products within the interior space. The lid panel 151,152 also contains a portion of a self locking feature 170. A further portion of the self locking feature 170 is contained by the end wall 18/19 as well. In the embodiment shown in FIG. 10, the lid panel contains a portion of the fold over flap 160 and a portion of a web 153 of the self locking feature 170. When the lid panel 151,152 is in either the closed or open position, the fold over flap 160 and the self locking feature 170 help secure and lock the end wall panel 18/19 and the lid panel 151,152 to the minor flaps 24, 25, 27, and 28 when the tray/container is erected. In a preferred embodiment, the self locking feature 170 contains the web 153 that engages a notch 180, preferably in the shape of a hook 184 (described below) that is located at the top edges of the minor flaps 24, 25, 27, and 28. Therefore, the self locking feature 170 not only helps to maintain the lid panel 151,152 in the open and closed positions, but also provides burst and stacking strength to the entire erected tray/container.

The lid panels do not contain the locking tabs 36 and 37 because the lid panels do not serve the same function as the roll over panels 22 and 23 mentioned above. Therefore, there may not be any locking of the lid panels into the openings 41 and 42 as mentioned above because at least a portion of the lid panel, as defined above, does not roll over to a position that is approximately perpendicular to the plane of the bottom panel 11. One preferable self locking feature is shown as 170 (FIG. 10). This self locking feature is preferably located such that a portion of it is contained within the lid panel 151,152 and a portion of it is contained within the end panel 18,19. The self locking feature 170 contains a web 153 and a fold over flap 160 that contains a heel 164. The web 153 is defined by cuts or relief slits 154 and 155 made transversely across fold line 156, and interrupting the fold line 156, the fold line 156 preferably extending completely across the width of lid panel 151 and/or 152, except at the webs 153 and the relief slits 154,155 (See FIG. 14). Short fold promoting slits 157*a* and 157*b* are preferably made approximately parallel to the fold line 156 on opposite sides thereof the web 153 in locations to define the length of the webs when the lid panel 151,152 and the end panel 18/19 are folded and erected into their locked position, placing the lid panel 151,152 in either its open or closed position. In other words, the fold promoting slits 157*a* and 157*b* initiate folding at opposite ends of the web 153 along fold lines 140141, extending through the fold promoting slits. The length of the web 153, as defined by the spacing between the relief slits 154,155; and thus between the fold lines 140,141 that may or may not extend through them, is substantially the same as the combined thicknesses of the total number of overlapping end panels. In an alternative embodiment, the structural integrity of the web 153 may be compromised, for example, the web 153 may be crushed to facilitate the self-locking function of this feature. Preferably, the structural integrity of the web is compromised in an area between the relief slits 154, 155 and fold promoting slits 157*a* and 157*b*. Preferably, when crushed, the crush is made on the surface of the web 153 that faces inwardly of the container when the container is erected. Crushing of the web 153 enables the web to extend more deeply into a notch 180 positioned to receive the same (described below), and provides a sharper fold along the fold lines 140/141 promoted by the slits 157*a* and 157*b*. It also enables other dimensions of the container to be tightened up, as described more fully below, developing a tighter and more reliable self locking arrangement.

Figure 14:
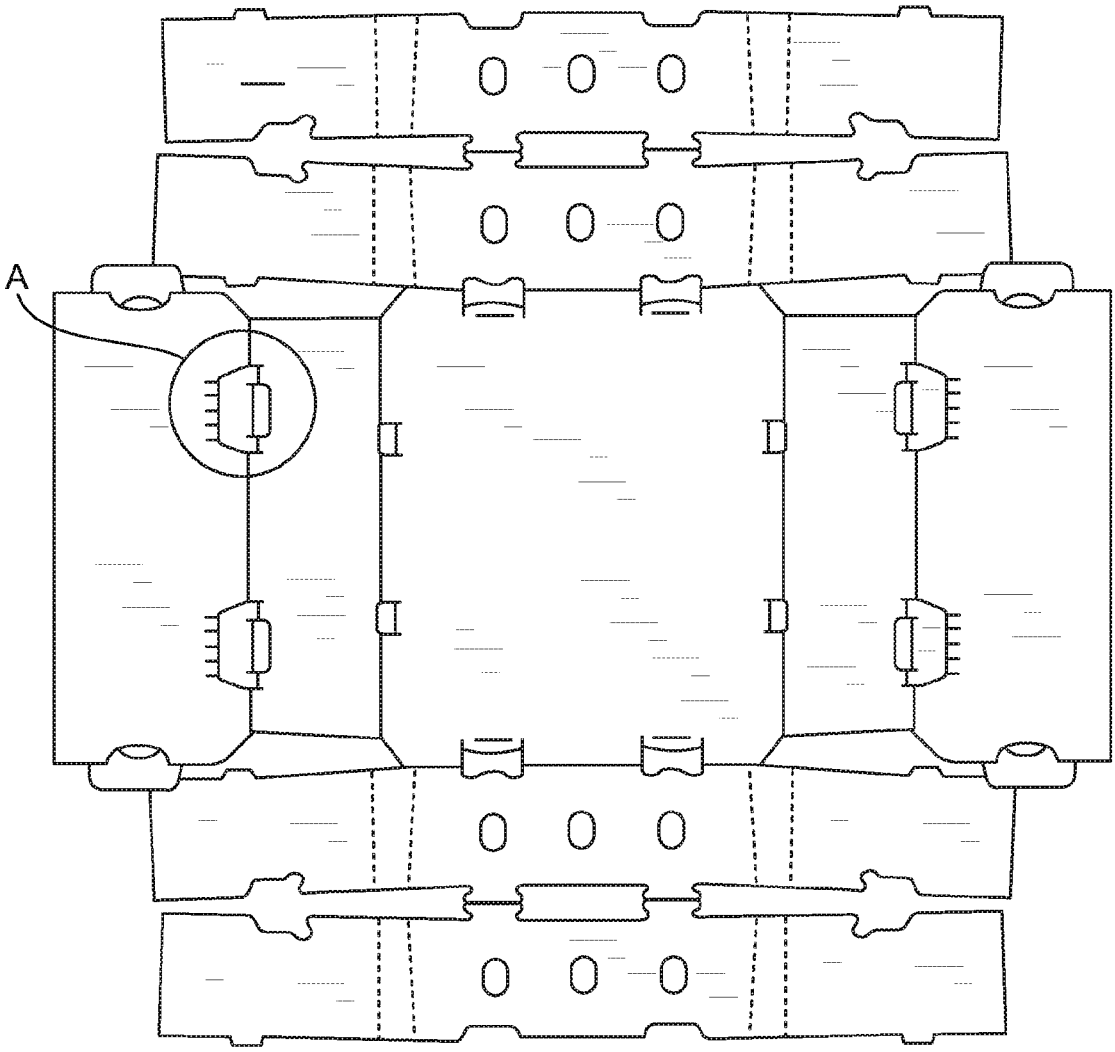
FIG. 14 is one embodiment of the self locking feature of the present invention.
Figure 14A:
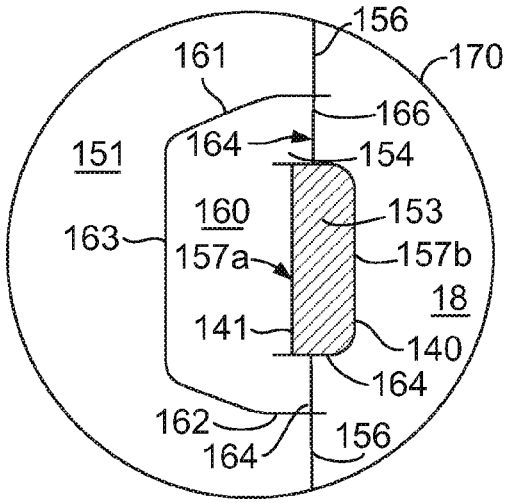
FIG. 14A is an enlargement of the area circled at "A" in FIG. 14.

The dimensional relationships of the self locking feature 170 can best be seen with particular reference to FIG. 14. The spacing between the slits 157*a* and 157*b* is selected to be substantially the same as the combined width of the total number of overlapping end panels 18,19. It should be noted that the relief slits 154 and 155 extend slightly beyond slit 157*a* a distance "C", defining relief slits for the fold over flap 160 (discussed above and in more detail below. Slit 157*a* is spaced from fold line 156 a distance "A" approximately equal to a thickness of one of the end panels 18/19, and slit 157*b* is spaced on the opposite side a distance "D" approximately equal to the combined thickness of the total number of overlapping end panels 18,19, minus the thickness of one panel.

The self locking feature may contain a fold over flap 160 that is defined by cut lines 161, 162, and 163. In this embodiment, the cut lines are such to define a fold-over flap 160 that is approximately trapezoidal in shape. However, the use of more or less cut lines may be implemented to promote any shape or size of the fold over flap 160. The fold over flap 160 is folded downwardly alongside a surface of the end panel 18,19, and/or in the alternative, a surface of the minor flap 24,25,27,28, so as to help position and secure the end wall panel 18/19 and the lid panel 151,152 in the properly erected from when the lid panel is in either the open or closed position. The fold over flap 160 contains at least one heel 164 that, when erected to place the lid panel 151,152 in either the open (see FIG. 11) or closed (See FIG. 12) position (or to place the self closing feature 170 in its locked position (see FIG. 11), extend upwardly and above the fold lines 140,141 that extend through slits 157*a*, 157*b*. The upper edge 166 of the heel 164 is preferably spaced above the top edges of the end wall 18/19, and the top edges of the minor flap 24,25,27,28; thus preventing the fold over flap 160 from disengaging from its locked position. Although the heel 164 may be any size, it is preferable that the upper edge of the heel 166, when the fold over flap 160 is in its operative folded position (i.e. the locked position seen in FIG. 11), is spaced below the upper edge of the notch 180, more preferably the upper surface of the web 153 resting in the notch 180, a distance "B" equal to at least the combined thickness of two panels; helping to secure the roll-over flap in its locked position.

Figure 15:
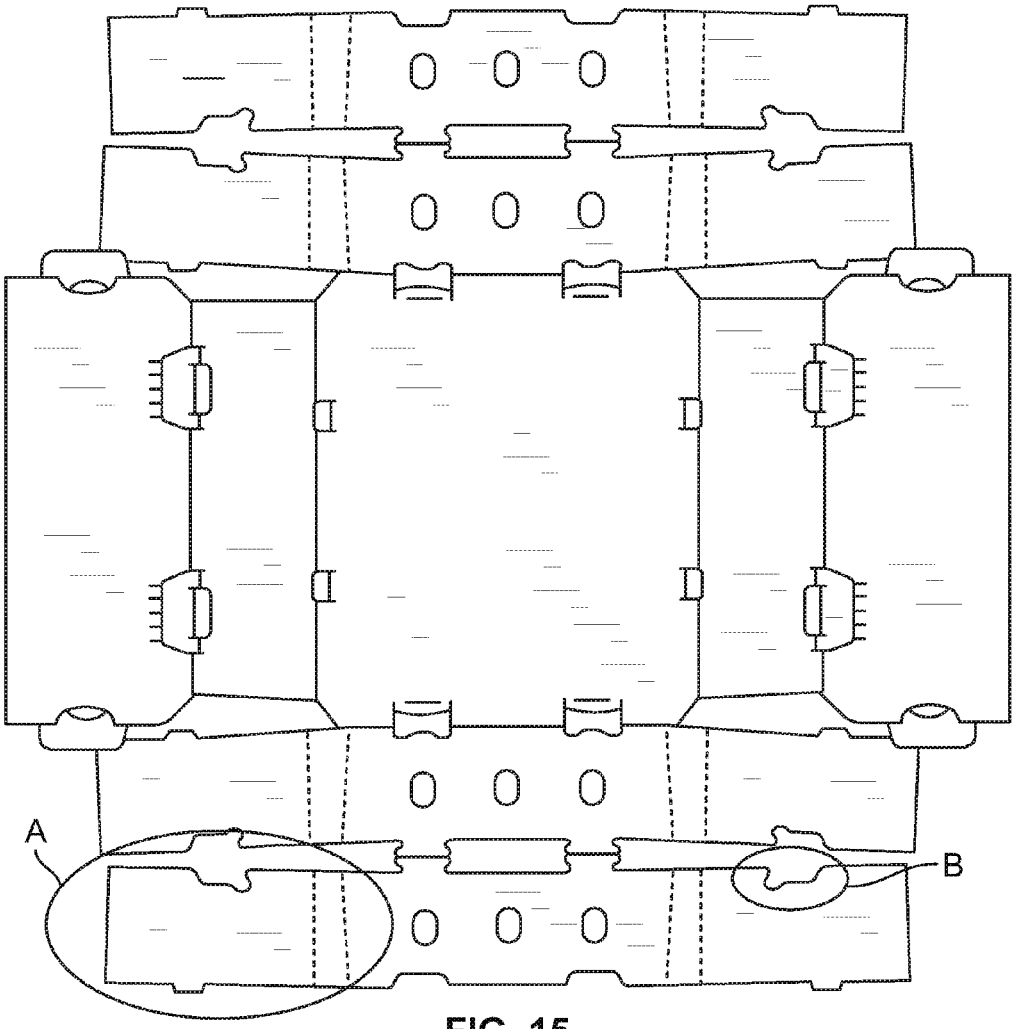
FIG. 15 is one embodiment of the notch according to the present invention.
Figure 15A:
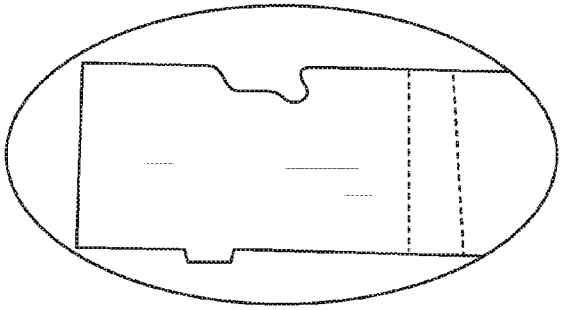
FIGS. 15A and 15B are enlargements showing details of the areas circled at "A" and "B", respectively, in FIG. 15.
Figure 15B:
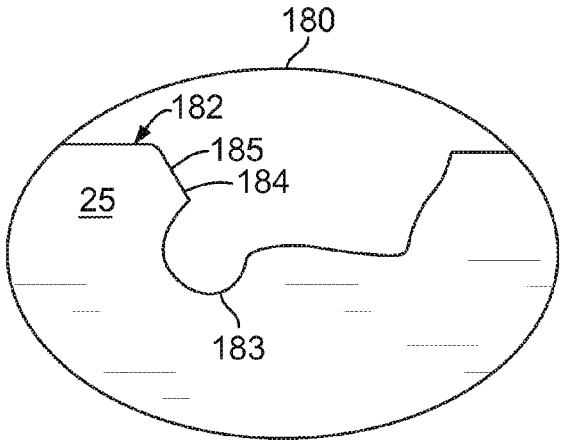

It is preferable to use the self locking feature 170 with a notch 180 in which the web 153 resides and/or with which the web 153 is engaged, when the self locking feature 170 is folded to be operable for securing the end panel 18,19 and the lid panel 151,152 in the open and/or closed position. When the blank/tray/container contains a notch 180 (See FIGS. 10 and 15), it is preferable that the notch 180 be contained within the minor flaps 24, 25, 27, and 28. More preferably, the notch 180 is located at the top edges 181,182 of the minor flaps 24, 25, 27, and 28 that are formed from the cut outs 45 in the blank. While the notch may be of any size and/or shape, in a preferable embodiment the notch 180 is at least one "hook" or shaped recess notch formed at one or more of the top edge 181,182 of the minor flaps 24,25,27,28. When erected to place the lid panel 18/19 in either the open or closed position, this hook or shaped recess notch engage a surface of the web 153 of the self locking feature 170 present in the lid panel 151/152 and the end panel 18/19. Further, this "hook" or shaped recess notch acts as a positive detent against the edge of the fold over flap 160, preventing it from opening when the lid panel 18/19 is either in the open or closed position. Preferably, the notch 180 is formed from a shaped cut 183 in one top edge 181,182 of at least one of the minor flaps 24,25,27, 28, forming an undercut nose or hook 184 at one side of the notch 180. It should be noted that the cut 183 also extends into the bottom of the notch 180.

When the lid panel 18,19 is positioned in either the open or closed position, the hook 184 on each flap 24,25,27,28 may point toward and/or away from the inner 12,13 and outer 16,17 side wall panel connected with the minor flap 24,25, 26,27. Thus, when the fold over flap 160 is folded inwardly and downwardly over the in-turned minor flaps 24,25,27,28 and the associated end panel 18/19 and when the web 153 is pulled down into the notches 180, at least a portion of the fold over panel 160 is engaged beneath the hook 184. When the hook 184 points toward the inner 12,13 and outer 16,17 side wall panel to which the associated the minor flap is joined, any outwardly directed force on the inner 12,13 and outer 16,17 side wall will tend to pull the associated minor flap and hook 184 toward the fold over flap 150 or web 153, tightening the engagement the portion of the web 153 beneath the hook 184, and securing the web 184 against displacement from the notch 180, thereby preventing/reducing the tendency for release of the fold over flap 160. It should be noted that while the hook 184 may be constructed in any manner, size and/or shape, a preferably construction of the hook 184 is rounded, having a tapered lead-in 185 that facilitates movement of the edge of the web 153 past the hook 184.

The lid panel may also contain at least one fastening feature 200. The fastening feature may be located anywhere within the lid panel 151,152, but preferably towards the outer edge 207/208 of the lid panel 151,152. The fastening feature 200, when folded in the operable structure, is used to fasten and secure the lid panel, when positioned in its closed position. In a preferred embodiment the lid panel is positioned on the top edge of at least one of the inner and outer side walls 12,13, 16,17 and/or end walls 18,19. In an alternative, the lid panel 151/152 may be fastened and/or secured to a top edge of the minor flaps 24, 25, 27, 28. While the above are a preferred embodiments, the fastening feature 200 may be used to fasten the lid panel 151,152 to any surface of the blank/tray/container so long as the surface to which the lid panel 151,152 is fastened contains a means for receiving the fastening feature 300, preferably a receiving tab 301 that positions the lid panel 151,152 in its closed position. The receiving tab 301 may be a further means to aid in the stacking of folded trays/containers. More preferably, at least one receiving tab 301 is located at the top edge of at least one of the side walls 12, 13, 16, 17 and/or end walls 18,19; or, at a top edge of the minor flap 24,25,26,27 or 28. The receiving tab 301 may be the result of a cut out in the blank 45. In a preferred embodiment, the tab is formed from at least one connecting web 47,48 See FIGS. 1-3 and 5-9). The connecting web 47,48, when the inner side wall panels 16 and 17 are folded upwardly and inwardly to lie against the respective panels 12 and 13, preferably create a receiving tab 301 that may be used as a means for receiving the fastening feature 200. This tab may also be used at the same time for stacking purposes as discussed above (see the discussion above on stacking tabs 49, 50; stacking tab openings 51, 52; and bendable tongues 53 and FIGS. 1-3 and 5-9). Thus the receiving tab 301 can serve a dual purpose function, preferably as a means for receiving at least one fastening feature 300 of at least one lid panel 151,152; and, as a means to secure vertically stacked trays/containers to one another.

The above mentioned fastening feature 200 may be any fastening feature 200 so long as it serves the function of securing/fastening at least one lid panel 151/152 to at least one surface of the tray/container. In a preferred embodiment, the fastening feature 200 contains a fastening flap 202/203 having an outer side edge 204/205 that projects farther away from the center of the bottom panel 11 than an outer side edge 207/208 of the lid panel 151/152. In an alternative embodiment, the fastening flap and the lid panel may share the same outer edges. More preferably, the lid panel 151,152 contains a plurality of fastening features 200, most preferably two fastening features 200. When a plurality of fastening features are present, it is preferred that at least two are located towards the outer side edge 207,208 of the lid panel 151,152. In a preferred configuration of the blank, the fastening features 200 are positioned such that a distance between an outer side edge 204 of a first fastening flap 202 and that of an outer edge 205 of a second fastening flap 203 is greater than the distance between the outside edges 207 and 208 of the lid panel 151, 152. In an alternative embodiment, the distance between an outer side edge 204 of a first fastening flap 202 and that of an outer edge 205 of a second fastening flap 203 is approximately equal to the distance between the outside edges 207 and 208 of the lid panel 151,152. In a further alternative embodiment, the distance between an outer side edge 204 of a first fastening flap 202 and that of an outer edge 205 of a second fastening flap 203 is less than the distance between the outside edges 207 and 208 of the lid panel 151,152.

Figure 16:
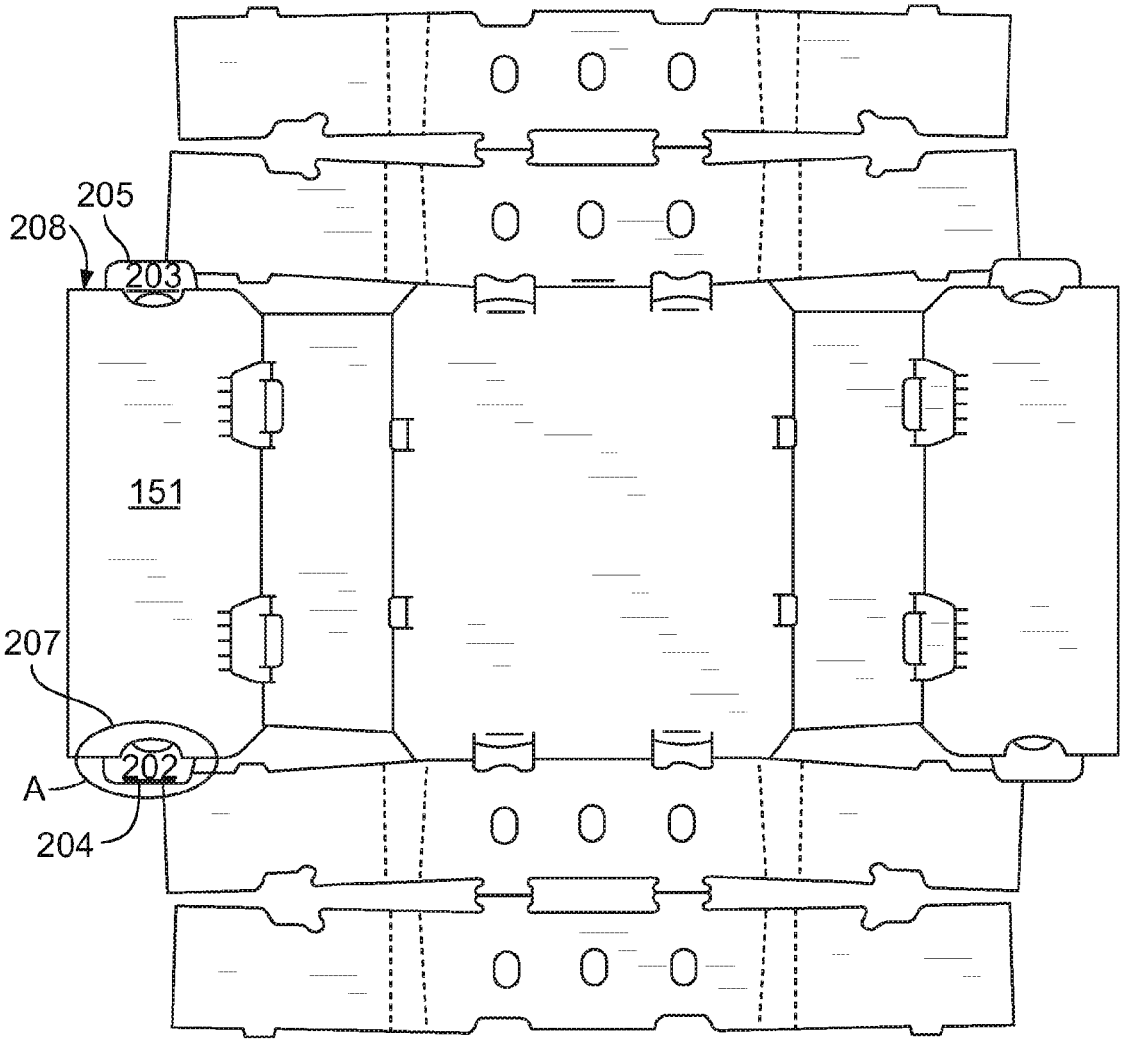
FIG. 16 is one embodiment of the fastening feature of the present invention.
Figure 16A:
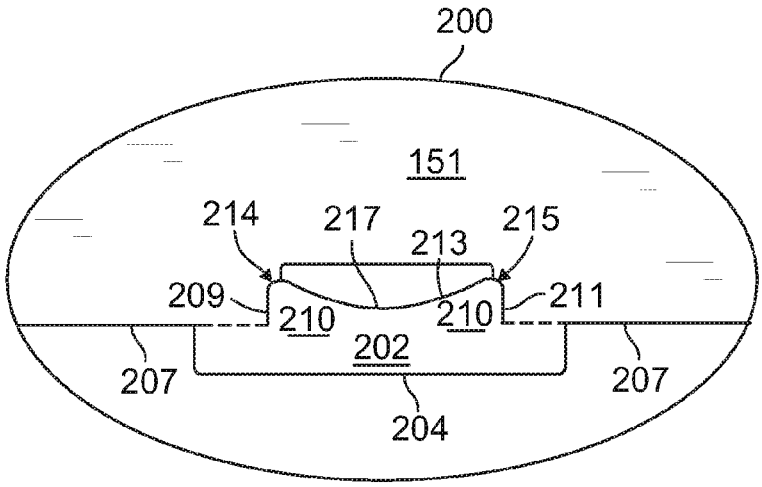
FIG. 16A is an enlargement showing details of the area circled at "A" in FIG. 16.

The fastening feature 200 includes a cut out portion 209 (See FIG. 16) that, when the lid panel 151,152 is folded upwardly and inwardly towards any of the above-mentioned means for receiving the fastening feature 300, forms an opening 220 (See FIG. 11) such that the receiving means 300 may interlock with the fastening means 200. In a preferred embodiment, the receiving means 300 is a receiving tab 301, preferably formed from at least one connecting webs 47 and 48 as described above and can aid in secure stacking of trays/containers as described above, as well as aid in the securing/fastening of the lid panel 151/152.

The fastening flap 202/203 includes a fastening tab or heel 210. When the lid panel 151,152 is in the closed position, the fastening tab 210 functions to provide friction force against a side of the receiving tab 301 so as to provide greater fidelity of interlocking the fastening feature 200 with the means for receiving the fastening feature 300. In the preferred embodiment, the fastening tab 210 is formed from cut lines 211, 212, and 213. Although the fastening tab may be any size and shape, in the preferred embodiment, cut lines 211 and 212 are positions to be approximately perpendicular to the outer side edge 207,208 of the lid panel 151,152. While cut line 213 may be of any shape, it is preferably to be in the form that creates a fastening tab that has a greater distance between the outer edges 214 and 215 of the fastening tab 210 and the outer edges 204,205 of the fastening flap 202,203 than the distance between the middle edge 217 of the fastening tab 210 and the outer edges 204,205 of the fastening flap 202. In the preferred embodiment, when the tray/container is constructed so that the lid panel 151,152 is in the closed position, the fastening flap 202,203 is folded towards the receiving tab 301 and then outwardly (away from the interior of the tray/container) and downwardly over the outside surface of the outer side panel 12 such that the receiving tab 301 penetrates into the opening left by the cut out portion 209, e.g. a locked position (see FIG. 13). The fastening flap 202,203 may also fold in a manner that positions it between the inner side wall panel 16,17 and the outer side wall panel 12,13, e.g. a locked position. This folding may also be accommodated by compromising a surface of the fastening flap, preferably by crushing at least a portion of the fastening flap (similar to crushing the web 153 discussed above). The receiving tab 301 may preferably be in frictional contact with the inner edges of the opening left by the cut out portion 209. This folding caused the fastening tab 210 to project upwardly above the upper edge of the inner and/or outer side wall 12,13 and 16,17and slightly towards the interior of the tray/container, resting closely beside, if not in frictional engagement with, the receiving tab 301 that not only penetrates, but may preferably protrude, through the opening 220 left by the cut out portion 209, e g. a locked position (see FIG. 13). The fastening tab 210 acts similarly to the heels 164 of the preferred self locking feature 170 described above; and, may preferably extend above the top edge of the inner 12/13 and/or outer 16/17 side walls so as to be in contact with a portion of the receiving tab 301 in a manner that prevents the fastening flap 202 from disengaging from a locked position.

The above-mentioned lid panel, fastening feature, self-locking feature and means for receiving the fastening feature embodiments should be understood to be able to be utilized with any blank/tray/container/packaging system, including those containing 4, 5, 6, 7, 8, or even greater sides. Further, those tray/container/packaging system's that contain at least one inner and at least one outer wall may include these embodiments, especially those having an inner/outer wall corner configuration as follows: square/square, diagonal/diagonal, square/diagonal and diagonal/square. Any one or more of the above configurations may be used in the tray/container/packaging system that contains the above embodiments. For example, an eight-sided tray/container/packaging system having at least four corners may have at least four corners of the diagonal/diagonal inner/outer wall configuration. Alternatively, an eight-sided tray/container/packaging system having at least four corners may have at least three corners of the diagonal/diagonal inner/outer wall configuration and at least one corner of the diagonal/square configuration. The above examples are not meant to be limiting in any fashion. Further, in the above examples and embodiments, a square corner is one in which at least one side wall and at least one end wall contact each other to form a corner having about an angle of about 90°. Further, in the above examples and embodiments, a diagonal corner is one in which at least one side wall and at least one end wall contact each other to form a corner having about an angle that is greater than about 90°. This is only representative and not meant to be limiting in any manner.

In other embodiments the width of the side and end walls, as well as the minor flaps may be smaller or larger than what is described herein. If larger, then the inside space of the constructed tray/container/packaging system would increase in volume. One example of such a conventional tray/container/packaging system is represented in US Published Patent Application 2006-0091194 having U.S. Ser. No. 11/303,898, filed Nov. 19, 2005, which is hereby incorporated, in their entirety, herein by reference.

In additional alternative embodiments, the lid panel 151, 152 may have a width and/or length that is equal to or less than half the width and/or length of the bottom panel 11. In an additional embodiment, the blank may contain two lid panels, each having a width and/or length that are each approximately equal to half the width and/or length of the bottom panel 11; thus creating approximately a fully-lidded tray/container when the tray/container is erected from the blank and both lid panels 151,152 are in the closed position; which may placed the lid panels 151,152 about parallel to the plane of the bottom panel 11. In a further embodiment, the blank may contain two lid panels 151,152 , each having a width and/or length that are each equal to less than half the width and/or length of the bottom panel 11 (but still have a width and/or length that is greater than about 1 inch); thus creating approximately a partially-lidded tray/container when the tray/container is erected from the blank and both lid panels 151,152 are in the closed position, preferably the lid panels 151,152 are positioned about parallel to the plane of the bottom panel 11.

In a further alternative embodiment, the lid panels 151,152 contain at least one self-locking feature; and, the lid panel 151,152 may also contain at least one locking tab 36/37 in the case that a portion of the lid panel 151,152 does roll over to a position that is approximately perpendicular to the plane of the bottom panel 11, performing a similar function as the roll over panel 22,23. In the alternative, the fastening feature may further contain at least one locking tabs 36,37, enabling it to perform a similar function as the roll over panel 22,23. The performance and function of the roll over panel is discussed above.

In a further alternative embodiment, the blank/tray/container of the present invention may contain a plurality of self locking features 170. However, it is preferable that each lid panel 151,152 contain at least one, preferably two, self locking features 170. Of course, there will preferably be a number of notches 180 that equal the number of self locking features 170 present in the tray/container, although there also may be more or less. However, the blank may preferably contain more notches 180 than self locking features 170 due to when there are multi-wall embodiments and the notches within each wall should preferably align up approximately squarely when the blank is constructed into the corresponding tray/container. The notches may be of any size and positioned anywhere. Although, it is preferable that the notches are positioned such that when the blank is folded in its operable form, a notch positioned and contained in one minor flap is aligned with a notch that is positioned and contained in an adjacent minor flap. In order to accomplish this in the preferred embodiment of the blank, the notch of a minor flap 27/28 is preferably approximately a mirror image of the notch of an adjacent minor flap 24/25.

It should be noted that the walls (end or side) of the tray/container may contain more than one end panel and/or more than one minor flap panel and/or more than one side wall panel folded therein, as well as any combinations thereof to form a multi-layered wall configuration. The multilayered or multiwalled end wall may have at least 2 walls, preferably three or more. Further, portions of the walls may be multi-walled, while other portions are single walled structures. In addition, the end walls may be longer and/or wider than the side walls. Further, end wall panels may be longer and/or wider than the side wall panels. Further, the side walls may be longer and/or wider than the end walls. Further, side wall panels may be longer and/or wider than the end wall panels. Accordingly, the relative length and width of the side and end walls may be of any relative length and width.

Further, while not required, it is preferred that the blank/tray/container have vent holes located therein. For example, FIG. 10 shows at least one vent hole 600 located in a side wall of one embodiment of a blank according to the present invention, while FIGS. 11 an 12 show at least one vent hole 600 located in the side walls of one embodiment of a tray/container according to the present invention. The location, position, size and geometry of the vent hole within the blank/tray/container may vary greatly and in any manner so long as it does not destroy the operability of any one or more of the embodiments of the present invention While the invention has been described and illustrated with reference to one or more preferred embodiments thereof, it is not the intention of the Applicants that the invention be restricted to such detail. Rather, it is the intention of the Applicants that the invention be defined by all equivalents, both suggested hereby and known to those of ordinary skill in the art, of the preferred embodiments.

The invention claimed is:

1. A container having opposed side walls, opposed end walls, and a bottom wall, said bottom wall cooperating with said side walls and said end walls to define an interior space, said container comprising:

a lid foldably connected along a fold line to an upper edge of at least one of said end walls, said lid being foldable relative to said at least one end wall so as to be moveable between an open position and a closed position, wherein said lid at least partially covers said interior space when in said closed position;

said side walls each comprising an outer side wall panel and an inner side wall panel foldably joined to one another by spaced webs forming upwardly extending tabs on respective upper edges of the side walls, said inner side wall panels lying against an interior surface of a respective outer side wall panel and being substantially coextensive in height and length therewith;

a minor flap on each of the opposite ends of each said inner and outer side wall panel, said minor flaps folded inwardly from respective said inner and outer side wall panels to lie against one another and against a respective adjacent said end wall and terminating at an inner end lying against said end wall;

a shaped notch formed in an upper edge of each said minor flap, said shaped notches each having an undercut shoulder at one side edge thereof;

a self-locking feature formed in said lid adjacent each said minor flap, each said self-locking feature being defined by spaced cuts extending into said lid from said fold line to form a roll-over flap cut from said lid, said roll-over flap connected at one end thereof with said at least one end wall by a web, said spaced cuts extending across said fold line at opposite ends of said web and into said one end wall to define a heel on said one end of said roll-over flap, said heel being cut from an upper edge of said end wall, each said roll-over flap being folded from the plane of said lid and inwardly and downwardly over an adjacent said minor flap to lie against an inner surface of a respective adjacent said minor flap, with said web received in said shaped notch so that one edge of said web is engaged beneath said undercut shoulder and said heel extends upwardly from said roll-over flap and lies against an inner surface of a respective adjacent said minor flap, said shaped notch forming a detent to retain said web therein, and said roll-over flaps holding said minor flaps in position against a respective said end wall;

openings formed in said lid where material has been removed between said cuts to form said roll-over flaps; and a locking flap foldably joined to each of the opposite end edges of said lid along respective fold lines collinear with a respective said end edge, cuts extending from said fold lines into a respective adjacent edge of said lid to form a heel portion on each said locking flap and an opening at each said end edge, said tabs on the upper edges of the inner and outer side wall panels extending into said openings when said locking flaps are folded downwardly against an outer surface of a respective said end wall, and said heel portion extending upwardly and lying against an outer surface of a respective said tab to hold said locking flaps in downwardly folded locked positions to hold said lid closed.

2. The container as claimed in claim 1, wherein:

at least one of said side walls and end walls is inwardly inclined to prevent nesting of one said container into another said container when the containers are stacked on top of one another.

3. The container as claimed in claim 1, wherein:

a narrow diagonally extending corner panel is connected between each said minor flap and an associated said side wall.

4. The container as claimed in claim 1, wherein:

ventilation openings are formed in at least one of said side walls and end walls.

5. The container as claimed in claim 1, wherein:

said spaced upwardly extending tabs on the upper edges of said side walls form stacking tabs; and at least one opening is in the bottom wall of the container in position to receive the stacking tabs of a subjacent container when said containers are stacked on top of one another.

6. The container as claimed in claim 3, wherein:

the narrow diagonally extending corner panels form exterior corners of the container, and corners of the bottom wall extend beyond the diagonal corner panels.

7. A container having opposed side walls, opposed end walls, and a bottom wall, said bottom wall cooperating with said side walls and said end walls to define an interior space, said container comprising:

a minor flap on each of the opposite ends of each said side wall, said minor flaps folded inwardly from said side walls to lie against a respective adjacent said end wall;

a shaped notch formed in an upper edge of each said minor flap, said shaped notches each having an undercut shoulder at one side edge thereof;

a lid foldably connected along a first fold line to an upper edge of at least one of said end walls, said lid being foldable relative to said at least one end wall so as to be moveable between an open position and a closed position, wherein said lid at least partially covers said interior space when in said closed position;

a roll-over flap cut from said lid by spaced cuts extending into said lid from said first fold line, said roll-over flap connected at one end thereof with said at least one end wall by a web, said spaced cuts extending across said first fold line at opposite ends of said web and into said one end wall to define a heel on said one end of said roll-over flap, said heel lying on a side of said first fold line opposite said flap, each said roll-over flap being folded from the plane of said lid and inwardly and downwardly over an adjacent said minor flap to lie against an inner surface of a respective adjacent said minor flap, with said web received in said shaped notch so that one edge of said web is engaged beneath said undercut shoulder and said heel extends upwardly from said roll-over flap and lies against an inner surface of a respective adjacent said minor flap to hold said minor flaps in position against a respective said end wall;

at least one tab projecting upwardly from an upper edge of each said side wall; and a locking flap foldably joined to each of the opposite end edges of said lid along respective second fold lines collinear with a respective said end edge, cuts extending from said second fold lines into a respective adjacent edge of said lid to form a heel portion on each said locking flap and an opening at each said end edge, said tabs on the upper edges of the side walls extending into said openings when said locking flaps are folded downwardly against an outer surface of a respective said end wall, and said heel portion extending upwardly and lying against an outer surface of a respective said tab to hold said locking flaps in downwardly folded locked positions to hold said lid closed.

* * * * *